US009976314B2

(12) United States Patent
Sakata et al.

(10) Patent No.: US 9,976,314 B2
(45) Date of Patent: May 22, 2018

(54) METHOD FOR MANUFACTURING CONCRETE STRUCTURE, CONCRETE CURING SHEET FOR CURING CONCRETE

(71) Applicant: Kajima Corporation, Minato-ku, Tokyo (JP)

(72) Inventors: Noboru Sakata, Tokyo (JP); Kenzo Watanabe, Tokyo (JP); Tatsuya Nukushina, Tokyo (JP); Goro Sakai, Tokyo (JP); Shuji Yanai, Tokyo (JP); Kosuke Yokozeki, Tokyo (JP); Mitsunori Iwata, Tokyo (JP); Kazunori Nishioka, Tokyo (JP); Keiji Kondo, Tokyo (JP); Taizo Goda, Tokyo (JP); Shusaku Hirata, Tokyo (JP)

(73) Assignee: KAJIMA CORPORATION, Minato-Ku, Tokyo (JP)

( * ) Notice: Subject to any disclaimer, the term of this patent is extended or adjusted under 35 U.S.C. 154(b) by 298 days.

(21) Appl. No.: 14/767,206

(22) PCT Filed: Feb. 14, 2014

(86) PCT No.: PCT/JP2014/053524

§ 371 (c)(1),
(2) Date: Aug. 11, 2015

(87) PCT Pub. No.: WO2014/129406

PCT Pub. Date: Aug. 28, 2014

(65) Prior Publication Data

US 2015/0375420 A1 Dec. 31, 2015

(30) Foreign Application Priority Data

Feb. 19, 2013 (JP) ..... P2013-030325
Apr. 25, 2013 (JP) ..... P2013-092281
(Continued)

(51) Int. Cl.
*E04G 9/10* (2006.01)
*E04G 15/04* (2006.01)
*E04G 17/06* (2006.01)

(52) U.S. Cl.
CPC ..... *E04G 9/10* (2013.01); *E04G 15/04* (2013.01); *E04G 17/06* (2013.01); *E04G 17/0644* (2013.01)

(58) Field of Classification Search
None
See application file for complete search history.

(56) References Cited

U.S. PATENT DOCUMENTS

2010/0292389 A1* 11/2010 McAuliffe ..... C04B 41/009 524/501

FOREIGN PATENT DOCUMENTS

JP 63306003 A * 12/1988
JP S63-306003 12/1988
(Continued)

OTHER PUBLICATIONS

English translation of International Preliminary Report on Patentability for Appl. No. PCT/JP2014/053524, dispatched Sep. 3, 2015, 11 pgs.

*Primary Examiner* — Alison L Hindenlang
*Assistant Examiner* — Jamel M Nelson
(74) *Attorney, Agent, or Firm* — Squire Patton Boggs (US) LLP

(57) ABSTRACT

A method for manufacturing a concrete structure comprises an installation step of installing a formwork 30 for concrete placement, a placement step of performing concrete placement in a state where a curing sheet 10 is attached to an inner surface of the formwork 30, and a demolding step of removing the formwork 30 after placement of concrete C. A contact angle of a contact surface of the curing sheet 10 for
(Continued)

use in the placement step with water is 50 degrees or more, wherein the contact surface faces the concrete. Thus, generation of bleeding water is suppressed.

13 Claims, 53 Drawing Sheets

(30) Foreign Application Priority Data

Apr. 26, 2013 (JP) ..... P2013-094512
Apr. 26, 2013 (JP) ..... P2013-094531

(56) References Cited

FOREIGN PATENT DOCUMENTS

| | | | | |
|---|---|---|---|---|
| JP | H2-020633 | | | 2/1990 |
| JP | H2-183049 | | | 7/1990 |
| JP | H3-099805 | | | 4/1991 |
| JP | 05149001 | A | * | 6/1993 |
| JP | H5-149001 | | | 6/1993 |
| JP | 07102763 | A | * | 4/1995 |
| JP | H7-102763 | | | 4/1995 |
| JP | H8-027956 | | | 1/1996 |
| JP | H10-058417 | | | 3/1998 |
| JP | H10-061184 | | | 3/1998 |
| JP | 2003-221928 | | | 8/2003 |
| JP | 2003221928 | A | * | 8/2003 |
| JP | 2007-077754 | | | 3/2007 |
| JP | 2010-024785 | | | 2/2010 |
| JP | 2010-196396 | | | 9/2010 |
| JP | 2010-222837 | | | 10/2010 |
| JP | 2010222837 | A | * | 10/2010 |

* cited by examiner (a)

(b)

(a)

(b)

(a)

(b)

(c)

(a)

(b)

METHOD FOR MANUFACTURING CONCRETE STRUCTURE, CONCRETE CURING SHEET FOR CURING CONCRETE

TECHNICAL FIELD

The present invention relates to a method for manufacturing a concrete structure, and a concrete curing sheet for curing concrete.

BACKGROUND ART

In order to manufacture a concrete structure, in general, concrete is first placed in formworks installed at a predetermined position, and then, the formworks are removed after concrete is set to some extent and hardened. Thereafter, a curing sheet is attached to a concrete surface from which the formworks are removed, for a predetermined period, and concrete is wet cured so that a hydration reaction proceeds. Meanwhile, concrete used for placement has increased fluidity so that concrete can be filled in every corner of the formworks, and includes excess water in an amount more than necessary for initial hardening of cement. Thus, after concrete is placed, such excess water may aggregate on the concrete surface as bleeding water, resulting in an insufficient strength of the concrete surface, or formation of air bubbles (pockmarks) on the concrete surface.

Then, for example, Patent Literature 1 proposes use of a sheet in which many pores are punched so that bleeding water generated after placement can be discharged to the outside. On the other hand, demolded concrete set to some extent and hardened is required to be in a wet state on the surface thereof in order to promote a hydration reaction of cement and water. Consequently, curing water is supplied to the concrete surface, and also the concrete surface is covered with a non-punched sheet or an unwoven fabric, on the contrary to the stage immediately after placement (see, for example, Patent Literatures 2 and 3).

CITATION LIST

Patent Literature

[Patent Literature 1] Japanese Patent Application Laid-Open No. H03-99805

[Patent Literature 2] Japanese Patent Application Laid-Open No. H07-102763

[Patent Literature 3] Japanese Patent Application Laid-Open No. 2010-24785

[Patent Literature 4] Japanese Patent Application Laid-Open No. 2007-077754

SUMMARY OF INVENTION

Technical Problem

Meanwhile, it is believed that the amount of water required for the hydration reaction of cement is about 40% based on the weight of cement, and that about 25% by weight of the water is chemically bound to cement and about 15% by weight of the water is adsorbed to cement and the like as gel water. On the other hand, the ratio of water to cement (W/C) in concrete is generally about 40 to 55% by weight, and it can be said that concrete by itself originally has a minimum amount of water required for the hydration reaction of cement. As described above, however, it is necessary to discharge excess water to the outside as much as possible in order to reduce generation of bleeding water in the initial hardening stage of cement. On the other hand, it is necessary to supply curing water separately in the stage where the hydration reaction of cement proceeds, and it cannot be helped that water is used in a more amount than necessary in order to develop predetermined compressive strength and durability.

Thus, an object of the present invention, in one aspect, is to provide a method for manufacturing a concrete structure that can efficiently utilize water to manufacture a concrete structure having predetermined qualities, and a curing sheet for use in the manufacturing method.

Solution to Problem

In order to solve the above problems, the present inventors have focused on, in the course of intensive studies, the following: concrete originally has a minimum amount of water required for the hydration reaction of cement, and if concrete can be hardened while suppressing generation of bleeding water, water can be allowed to remain in concrete in an amount necessary for the hydration reaction even after removing formworks. Then, the present inventors have made further studies, and obtained the following finding: when a concrete surface is covered with a curing sheet having a predetermined contact angle in concrete placement, generation of bleeding water can be effectively suppressed; and thus the present inventors have completed the present invention.

That is, in one aspect, the method for manufacturing a concrete structure according to the present invention comprises a mold installation step of installing a formwork for concrete placement, a placement step of performing placement of concrete in a state where a curing sheet is attached to an inner surface of the formwork, and a demolding step of removing the formwork after placement of the concrete, wherein a contact angle of a contact surface of the curing sheet facing the concrete with water is 50 degrees or more.

The method for manufacturing a concrete structure uses the curing sheet having a contact angle with water of 50 degrees or more in placement. In this case, it is possible to effectively suppress generation of bleeding water usually generated in concrete-hardening after placement. The reason why the generation of bleeding water is thus suppressed is believed as follows: when the contact angle (also referred to as "wetting angle") of the sheet surface (contact surface) of the curing sheet with which the concrete surface is covered is high, the action that pushes water which is included in the concrete and which tends to bleed to the outside from the surface thereof, and air present in the water back inside the concrete at the sheet contact surface is exerted, and as a result, hardening proceeds while the water and air therein remain in the concrete. The "contact angle" used here means a contact angle in the case where water has ordinary temperature (23° C.).

Then, according to the method for manufacturing a concrete structure, since generation of bleeding water is thus suppressed, the concrete contains water necessary for the hydration reaction after demolding, and thus, a concrete structure that can develop qualities such as predetermined compressive strength and durability can be manufactured without supplying curing water from the outside or using too much curing water in curing of the concrete. In addition, since air is inhibited from aggregating on the concrete surface, a surface texture can become dense and a cover can also be prevented from being partially damaged. Thereby qualities such as compressive strength and durability can be enhanced as compared with a conventional case. In addition, it is preferable that the method for manufacturing a concrete structure further comprise a curing sheet attachment step of attaching a curing sheet inside the formwork in advance before the mold installation step, but the curing sheet may also be attached to the formwork installed.

In addition, in the method for manufacturing a concrete structure, air in the concrete is inhibited from aggregating on the surface before demolding, as described above, and therefore air bubbles (pockmarks) can also be inhibited from being generated on the concrete surface to thereby allow a beautiful concrete structure good in outer appearance to be manufactured. Since the above curing sheet is easily released from the concrete, unlike a conventional case, the inner surface of the formwork is not required to be coated with a release agent for preventing the formwork from being adhered to the concrete, and therefore generation of contamination and stains on the concrete surface due to the release agent can also be prevented.

In addition, it is preferable that the method for manufacturing a concrete structure further comprise a curing step of curing the concrete structure for a predetermined period with the curing sheet left on an attaching surface of the concrete structure, after the demolding step. Such a sheet can be used to thereby wet cure the concrete over a long period even after removing the formwork. The predetermined period in the curing step may be 30 days or more or 90 days or more after removing the formwork. Furthermore, according to the above manufacturing method, it is also possible to perform curing for a long period with such a curing sheet left to stand for about 1 year after demolding.

In addition, in the method for manufacturing a concrete structure, the contact angle of the contact surface of the curing sheet for use in the placement step with water is more preferably 69 degrees or more, the contact angle of the contact surface of the curing sheet with water is further preferably 80 degrees or more, and the contact angle of the contact surface of the curing sheet with water is still further preferably 90 degrees or more. When the contact angle of the contact surface of the curing sheet with water is higher, the action that pushes water which is included in the concrete and which tends to bleed to the outside from the surface, and air present in the water back inside the concrete at the sheet contact surface is strongly exerted, and therefore water required for the hydration reaction can be sufficiently included to thereby still further enhance qualities such as compressive strength and durability of a concrete structure to be manufactured.

In the method for manufacturing a concrete structure, for the curing sheet for use in the placement step, for example, a sheet comprising a polymer compound such as polypropylene, nylon, nylon 6, a perfluoroalkoxy fluororesin, a tetrafluoroethylene hexafluoropropylene copolymer, an ethylene tetrafluoroethylene copolymer, polyethylene terephthalate (PET), polyvinyl chloride, polyvinyl acetate, polyvinylidene chloride and polyolefins can be used. In particular, a sheet comprising polypropylene, polyethylene terephthalate, polyvinylidene chloride or polyvinyl chloride can be used to thereby provide a more inexpensive curing sheet, and the sheet can be left on the concrete surface even after removing the formwork, to thereby easily make the curing period of the concrete longer.

In addition, in the method for manufacturing a concrete structure, the thickness of the curing sheet for use in the placement step may be 0.05 mm or more, or may be 0.1 mm or more. In this case, wrinkles can be hardly generated on the curing sheet so as to make the outer appearance of the concrete structure to be manufactured still more beautiful.

In addition, in the method for manufacturing a concrete structure, the water vapor permeability of the curing sheet for use in the placement step may be 10 $g/m^2 \cdot 24$ hours or less, and furthermore the water vapor permeability of the curing sheet may be 5 $g/m^2 \cdot 24$ hours or less. In this case, it is possible to further suppress permeation of water required for the hydration reaction to the outside. In addition, in the method for manufacturing a concrete structure, the carbon dioxide permeability of the curing sheet for use in the placement step may be 100,000 $cc/m^2 \cdot 24$ hours·atm or less, and furthermore the carbon dioxide permeability of the curing sheet may be 50,000 $cc/m^2 \cdot 24$ hours·atm or less. In this case, ingress of carbon dioxide to the concrete surface during curing can be suppressed to suppress carbonation of the concrete surface.

In addition, in the method for manufacturing a concrete structure, the durability of the curing sheet for use in the placement step against alkalis and water may be 3% or less in terms of the rate of change in length in immersion in an aqueous sodium hydroxide (NaOH) solution of pH 12 for 24 hours, and furthermore the rate of change in length may be 1% or less. In this case, a smooth concrete surface can be built up without causing creases and the like on the sheet after pouring of the concrete.

In addition, the method for manufacturing a concrete structure may also further comprise a bar arrangement step of arranging a predetermined reinforcing bar, wherein a reinforced concrete structure is manufactured as the concrete structure. According to this manufacturing method, since air bubbles generated on the concrete surface are suppressed, a cover thickness can be sufficiently taken and therefore rust on the reinforcing bar of the reinforced concrete structure to be manufactured can be still further effectively prevented. In addition, the cover thickness can be more certainly and sufficiently taken than that in a conventional procedure, and therefore a design cover thickness can also be thinner than that in a conventional procedure, to result in a reduction in the amount of the concrete for use in the concrete structure while a conventional strength being kept.

In addition, in the method for manufacturing a concrete structure, the specified design strength of the concrete for use in the placement step is not restricted, and any of the above effects is exerted on the concrete in all strength ranges. The specified design strength of the concrete may be, for example, 18 $N/mm^2$ or more and 33 $N/mm^2$ or less. According to the above manufacturing method, it is possible to easily take a long curing period, and therefore, by using ordinary concrete whose cost is saved rather than using so-called high strength concrete, a concrete structure having compressive strength and durability which are equal to or higher than those of a conventional structure can be manufactured.

In addition, in the method for manufacturing a concrete structure, a predetermined holding device may also be used in at least any step of the mold installation step, the placement step and the demolding step to thereby leave the curing sheet on the concrete after removing the formwork. For example, when the formwork is installed in the mold installation step, ends of the curing sheet attached to the inner surface of the formwork at the boundary portion of the formwork folded back so as to be substantially perpendicular to the formwork, and in the placement step, projecting portions folded back may also be embedded into the concrete in concrete placement to secure the curing sheet to the concrete, allowing folded-back portions of the curing sheet to be located at a predetermined interval. In this case, the end portions of the curing sheet can be easily secured near the boundary of the formwork, and therefore construction of the curing sheet and the formwork can be facilitated. In this case, the concrete surface at the mold boundary portion exposed between the curing sheets disposed at a predetermined interval can be covered with a tape member after removing the formwork to thereby suppress dissipation of moisture from the concrete, enabling more certain curing.

In addition, in order that the predetermined holding device is used to leave the curing sheet on the concrete after removing the formwork, the following (1) to (6) may be performed.

(1) For example, in the method for manufacturing a concrete structure, a separator to which a cone is mounted on each end portion may be installed in the mold installation step so that the cone hits the curing sheet disposed on the inner surface of the formwork, and after the demolding step, the curing sheet may be partially tucked between an embedding body for closing holes remaining on the concrete after removal of the cone, and the concrete, thereby allowing the curing sheet to be held. In this case, the curing sheet can be partially tucked between the embedding body and the concrete to thereby allowing the curing sheet to be properly held. Moreover, this method is advantageous in terms of cost because it is not necessary to provide a new member for holding the curing sheet or use an adhesive material.

In (1), in the placement step, concrete placement may also be performed in a state where the curing sheet is partially folded inside along with the cone. In this case, since concrete placement is performed in the state where the curing sheet is partially folded inside, a portion folded can be attached to the concrete due to hardening of the concrete to hold the curing sheet. Thus, when the cone is pulled out in demolding, the curing sheet can be avoided from being peeled off from the concrete, and thereafter properly held by the embedding body to perform curing as it is.

(2) In the mold installation step, a spacer for adjusting the interval between the reinforcing bar and the formwork may be installed to allow an end portion of the spacer to be connected to the curing sheet disposed on the inner surface of the formwork. In this case, since the end portion of the spacer is connected to the curing sheet by an adhesive, a pressure-sensitive adhesive or the like, the curing sheet can be properly held without being peeled off even in demolding or the like. A magnet may also be buried in the end portion of the spacer to allow the end portion of the spacer to be connected to the curing sheet by a magnetic force.

(3) In the placement step, concrete placement may also be performed in a state where a holding pin connected to a sheet stopper disposed outside the curing sheet penetrates through the curing sheet to project inside. In this case, since concrete placement is performed in the state where the holding pin projects to the inside the curing sheet, hardening of the concrete can allow the holding pin to be secured to the concrete, pressing the curing sheet by the sheet stopper to properly hold it.

(4) In the placement step, concrete placement may also be performed in a state where an anchor disposed inside the curing sheet and a long holding plate disposed along the outside of the curing sheet are bolted. In this case, since the long holding plate disposed along the outside of the curing sheet is bolted to the anchor, hardening of the concrete placed can allow the anchor to be secured to the concrete, thereby properly holding the curing sheet by the holding plate.

(5) In the placement step, concrete placement may also be performed in a state where a magnet is disposed inside the curing sheet, to allow the curing sheet to be held by disposition of a ferromagnetic body to be attracted to the magnet, or the magnet outside the curing sheet. In this case, since hardening of the concrete placed allows the magnet to be secured to the concrete, the magnet or the ferromagnetic body can be disposed outside the curing sheet to thereby properly hold the curing sheet.

(6) In the placement step, concrete placement may also be performed in a state where a magnet is disposed inside the curing sheet, to allow the curing sheet to contain a ferromagnetic body. In this case, since hardening of the concrete placed allows the magnet to be secured to the concrete, the curing sheet can be attracted to the magnet secured to the concrete, by a magnetic force, to thereby properly hold the curing sheet.

After the demolding step, there may further comprise a detaching step of pulling an extra length portion of a rigid wire rod integrated with the curing sheet, the portion projecting from the curing sheet, to thereby peel the curing sheet from the concrete. In this case, the extra length portion of a rigid wire rod can be pulled to thereby easily peel the curing sheet held on the concrete, making the detaching operation efficient.

In the method for manufacturing a concrete structure, in the mold installation step, the formwork for concrete placement may be installed so that the gradient is at least 1% or more, and in the placement step, concrete placement on a portion having the gradient may be performed in a state where the curing sheet is attached to the inner surface of the formwork. When a gradient portion on the concrete structure is formed, in general, air in the concrete is hardly discharged in concrete placement and surface air bubbles are easily generated. According to the above method, however, a curing sheet having a high contact angle can be attached to a formwork for gradient portion formation, to thereby inhibit air bubbles from reaching a surface portion, reducing generation of surface air bubbles.

In the method for manufacturing a concrete structure, in the placement step, concrete placement may be performed in a state where a heat insulation material is disposed between the curing sheet and the formwork, and in the demolding step, the formwork may be removed with the heat insulation material being left on the curing sheet. In this case, demolding can be performed early as compared with a case where a heat insulating formwork is used, and also rapid cooling until attachment of the heat insulation material can be prevented as compared with a case where the heat insulation material is attached separately after demolding. As a result, according to this method, temperature cracking or the like of the concrete can be prevented while the demolding can be performed early. It is preferable that the heat insulation material used here have a surface heat transfer coefficient of 8 $W/m^{2\circ}$ C. or less, for example.

In the method for manufacturing a concrete structure, in the placement step, a surface of the curing sheet, on which concrete is to be placed, may be coated with at least one of a surface modifier, a shrinkage reducer, a water absorption inhibitor and a release agent for performing concrete placement. In this case, it is possible to easily impart, to the concrete structure, not only smoothing and moisturizing of the surface, but also the additional effect by the agent used for coating. For example, when a surface modifier including an alkaline silicate or a cement type compound is used, silica gel or C—S—H (calcium-silicate hydrate) can be produced on the concrete surface to make the concrete texture dense.

When a shrinkage reducer including an alcohol type compound is used, the action of a surfactant can suppress the negative pressure generated in pore voids of the concrete to reduce drying shrinkage and the like. When a water absorption inhibitor including a silane type compound is used, a water absorption preventing layer can be formed on the concrete surface to suppress freezing damage. When an oily or aqueous release agent is used, releasing (ease of release) from the concrete can be still further enhanced to provide a more dense concrete surface. The above agents may be used singly or in combinations of a plurality thereof.

In addition, the method for manufacturing a concrete structure may comprise a providing step of providing a formwork having a plurality of openings which is to face concrete placed and having an internal void linked to the openings, and a curing sheet for curing concrete placed, and a pressure reduction step of mounting the curing sheet to a surface of the formwork which is to face concrete placed so as to cover the plurality of openings, and reducing atmospheric pressure in the internal void. In the placement step in this case, concrete placement is performed in a state where the curing sheet is attached to a surface of the formwork which is to face the concrete placed by the pressure reduction step. In this case, since the curing sheet may only be mounted along the formwork and subjected to pressure reduction, an operation in which the formwork and the curing sheet are purposely attached by a double-faced tape or the like can be omitted to make a providing operation of the curing sheet efficient.

In addition, in the demolding step, the formwork may be removed after the internal void under reduced pressure is opened to release the attachment state of the formwork and the curing sheet. In this case, the curing sheet can be easily mounted on an attaching surface of the concrete structure hardened.

In addition, a suction member is fixed to the formwork, and in the pressure reduction step, air in the internal void may be sucked by the suction member to reduce the atmospheric pressure in the internal void. In this case, the atmospheric pressure in the internal void of the formwork can be reduced by a simple configuration. It is preferable in this method for manufacturing a concrete structure that the formwork for use in the placement step have a formwork portion to face concrete placed, on which a plurality of openings are provided, and an outside formwork portion to which the suction member is fixed.

A holding system of the concrete curing sheet for use in the method for manufacturing a concrete structure includes, as one example thereof, a formwork having a plurality of openings to face concrete placed and an internal void linked to the openings, a curing sheet for curing concrete placed, and a suction member that can be fixed to the formwork. In this holding system, the curing sheet may be mounted to a surface of the formwork to face concrete placed so as to cover the plurality of openings, and may be attached to the surface of the formwork, to face concrete placed, in which the atmospheric pressure in the internal void is reduced by the suction member. When such a holding system is used, the atmospheric pressure in the internal void of the formwork can be reduced using the suction member to thereby easily attach the curing sheet to the formwork. Therefore, since the curing sheet may only be mounted along the formwork and subjected to pressure reduction, an operation in which the formwork and the curing sheet are purposely attached by a double-faced tape or the like can be omitted to make a providing operation of the curing sheet efficient.

In addition, in the method for manufacturing a concrete structure according to the present invention, in another aspect, placement is performed so that the concrete surface is covered with the curing sheet in performing of concrete placement, and the contact angle of a contact surface of the curing sheet facing the concrete with water is 50 degrees or more. This manufacturing method can also effectively suppress generation of bleeding water usually generated in concrete-hardening after placement, as with the method described above. Therefore, the concrete contains water necessary for the hydration reaction after demolding, and a concrete structure that can develop qualities such as predetermined compressive strength and durability can be manufactured without supplying curing water from the outside or using too much curing water in curing of the concrete. In addition, since air is inhibited from aggregating on the concrete surface, the surface texture can become dense, and a cover can also be prevented from being partially damaged. Thereby qualities such as compressive strength and durability can be enhanced as compared with a conventional case.

In addition, in still another aspect, the present invention can also be regarded as the invention of a concrete curing sheet for curing concrete. That is, this concrete curing sheet is a curing sheet that is attached to an inner surface of a formwork for concrete placement to be used for curing of concrete, wherein a contact angle of a contact surface facing the concrete with water is 50 degrees or more.

Since the curing sheet having such a contact angle can be used to thereby suppress generation of bleeding water usually generated in concrete-hardening, the concrete contains water necessary for the hydration reaction after demolding, and therefore a concrete structure that can develop qualities such as predetermined compressive strength and durability can be manufactured without supplying curing water from the outside or using too much curing water in curing of the concrete.

In addition, in the curing sheet, the contact angle of the contact surface with water is more preferably 69 degrees or more, the contact angle of the contact surface with water is further preferably 80 degrees or more, and the contact angle of the contact surface with water is still further preferably 90 degrees or more. When the contact angle of the contact surface of the curing sheet with water is higher, the action that pushes water which is included in the concrete and which bleeds to the outside from the surface, and air present in the water back inside the concrete at the sheet contact surface is strongly exerted, and therefore water required for the hydration reaction can be sufficiently incorporated to thereby still further enhance qualities such as compressive strength and durability.

In addition, the curing sheet may also be a sheet comprising polypropylene, polyethylene terephthalate, polyvinylidene chloride or polyvinyl chloride. In this case, a more inexpensive curing sheet can be provided, and can be left on the concrete surface even after demolding, to thereby easily make the curing period of the concrete longer.

In addition, the thickness of the curing sheet may be 0.05 mm or more. In this case, wrinkles can be hardly generated on the curing sheet to make the outer appearance of the concrete structure to be manufactured still more beautiful. The thickness of the curing sheet is more preferably 0.1 mm or more.

In addition, the water vapor permeability of the curing sheet may be 10 $g/m^2 \cdot 24$ hours or less, and furthermore the water vapor permeability may be 5 $g/m^2 \cdot 24$ hours or less. In this case, it is possible to suppress permeation of water required for the hydration reaction to the outside.

In addition, the carbon dioxide permeability of the curing sheet may be 100,000 cc/m$^2$·24 hours·atm or less, and furthermore the carbon dioxide permeability may be 50,000 cc/m$^2$·24 hours·atm or less. In this case, it is possible to suppress ingress of carbon dioxide to the concrete surface in curing to suppress carbonation of the concrete surface.

In addition, the curing sheet may further include a plurality of needle-like or sheet-like protrusions disposed at an end of a sheet main body, in which the plurality of protrusions may be disposed at a predetermined interval and substantially perpendicular to a surface of the sheet main body. In this case, such protruding portions can be used to thereby easily fix the curing sheet to the concrete in concrete placement. In this curing sheet, the plurality of protrusions may be made of the same material as that of the sheet main body and formed integrally with the sheet main body.

Advantageous Effects of Invention

According to the present invention, in one aspect, a concrete structure having predetermined qualities can be manufactured by effectively utilizing water.

BRIEF DESCRIPTION OF DRAWINGS

FIG. 27(*b*) is a perspective view illustrating a wheel-shaped spacer. FIG. 27(*c*) is a perspective view illustrating a substantially triangular plate-shaped block spacer.

FIG. 28(*b*) is a view for explaining a demolding step of the second modification.

FIG. 30(*b*) is a side view illustrating the holding pin.

FIG. 31(*b*) is a view for explaining a demolding step of the third modification. FIG. 31(*c*) is a view for explaining a detaching step of the third modification.

FIG. 34(*b*) is a view for explaining a bolting step of the fourth modification. FIG. 34(*c*) is a view for explaining a demolding step of the fourth modification.

FIG. 39(*b*) is a view for explaining a state where a piano wire and the curing sheet are secured.

DESCRIPTION OF EMBODIMENTS

Hereinafter, embodiments of the method for manufacturing a concrete structure according to the present invention and a concrete curing sheet that can be used in the method are described in detail with reference to drawings.

Figure 1:
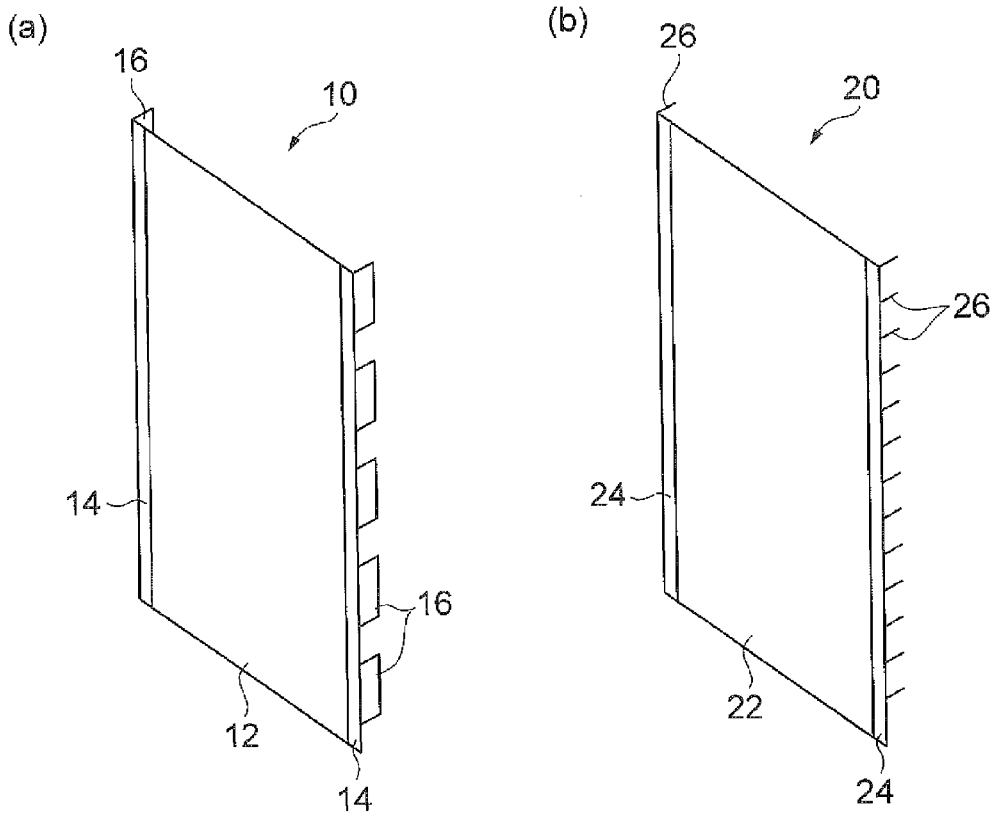
FIG. 1 is a perspective view illustrating an example of a curing sheet for use in a method for manufacturing a concrete structure according to one embodiment of the present invention.

First, the concrete curing sheet for use in the method for manufacturing a concrete structure is described with reference to FIG. 1 and FIG. 2. FIG. 1 illustrates a curing sheet for use in the method for manufacturing a concrete structure. As illustrated in FIG. 1(*a*), a curing sheet 10 is a concrete curing sheet having a predetermined thickness, and presents, for example, a substantially rectangular shape. The curing sheet 10 includes a rectangular-shaped sheet main body 12, end portions 14 positioned at both ends in the width direction of the sheet main body 12, and a plurality of protruding portions 16 extending from both the end portions 14 toward a direction where concrete is to be placed. In the present embodiment, the sheet main body 12, the end portions 14 and the protruding portions 16 are made of, for example, the same material, and integrally formed, but may also be formed so that the protruding portions 16 are provided as other bodies and are connected to the end portions 14. The thickness of the curing sheet 10 is preferably 0.05 mm or more, further more preferably 0.1 mm or more, for example, about 0.1 mm to 2 mm.

Each of the protruding portions 16 presents a rectangular shape (sheet shape) in which the length in the vertical direction illustrated in the FIG. 1 is, for example, 5 to 50 mm (preferably 20 to 30 mm) and the width as the depth is, for example, 1 to 20 mm (preferably 5 to 10 mm). The thickness of each of the protruding portions 16 is, for example, 0.1 to 2 mm. Such protruding portions 16 are disposed at a predetermined interval, for example, 5 to 50 mm (preferably 10 to 30 mm) in the vertical direction, and are folded toward a direction where concrete is to be placed, so as to be substantially perpendicular to the surface of the sheet main body 12. Most of such protruding portions 16 are embedded in concrete at the time of concrete placement, to allow the curing sheet 10 to be attached to concrete certainly.

As the curing sheet for use in the present embodiment, a sheet having a configuration illustrated in FIG. 1(*b*) may also be used. A curing sheet 20 illustrated in FIG. 1(*b*) similarly includes a rectangular-shaped sheet main body 22, end portions 24 positioned at both ends in the width direction of the sheet main body 22, and a plurality of protruding portions 26 extending from both the end portions 24 toward a direction where concrete is to be placed. In the curing sheet 20, however, the protruding portions 26 have a different shape from those of the protruding portions 16, and have a needle shape. In such protruding portions 26, the width (the length of the needle) as the depth is, for example, 1 to 20 mm (preferably 5 to 10 mm), and the thickness is, for example, 0.1 to 2 mm. Such protruding portions 26 are disposed at a predetermined interval, for example, 5 to 50 mm (preferably 10 to 30 mm) in the vertical direction, and are folded toward a direction where concrete is to be placed, so as to be substantially perpendicular to the surface of the sheet main body 22.

A continuous body such as a kite string may also be attached near each of corner portions of the protruding portions 16 and 26 on the folded side of the curing sheets 10 and 20 so as to be sandwiched between each of the sheets and concrete. In this case, a detaching operation in sheet removal described later can also be made easier. The curing sheets 10 and 20 may be rectangular-shaped sheets in which the protruding portions 16 and 26 are eliminated, respectively. In this case, curing can be performed appropriately using an adhesive, other hooking member or the like so that the curing sheets 10 and 20 are not peeled from concrete. Other method for leaving the curing sheet on the concrete is described later.

As the material for the curing sheets 10 and 20, for example, a polymer compound such as polypropylene, nylon, nylon 6, a perfluoroalkoxy fluororesin, a tetrafluoroethylene hexafluoropropylene copolymer, an ethylene tetrafluoroethylene copolymer, polyethylene terephthalate (PET), polyvinyl chloride, polyvinyl acetate, polyvinylidene chloride or polyolefins can be used. A curing sheet comprising polypropylene, polyethylene terephthalate, polyvinylidene chloride or polyvinyl chloride that is generally used and is relatively low in cost is preferable in consideration of being attached to a concrete surface as it is in order to take a long curing period.

Such curing sheets 10 and 20 have a contact angle θ (wetting angle) of its surface (contact surface) which is in contact with concrete placed with water of at least 50 degrees or more, and preferably this contact angle is higher. Specifically, the contact angle θ of the contact surface of each of the curing sheets 10 and 20 with water is preferably 69 degrees or more, the contact angle θ is further preferably 80 degrees or more, and the contact angle θ is still further preferably 90 degrees or more. The surface of the material can be processed by various surface processing techniques to thereby appropriately adjust the contact angle with water. Herein, the "contact angle θ" used here means a contact angle in the case where water has ordinary temperature (23° C.).

Figure 2:
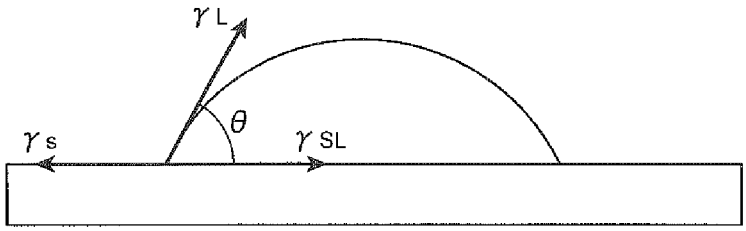
FIG. 2 is a schematic view illustrating the contact angle of the surface of the curing sheet with water.
Figure 2:
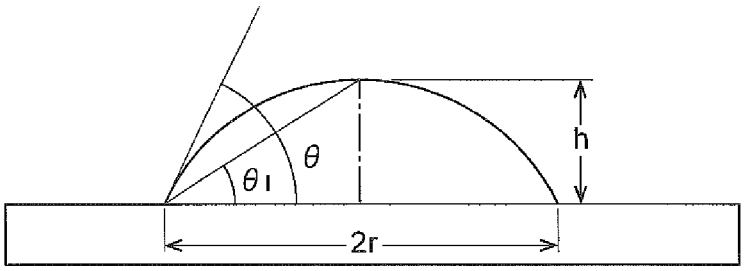

Herein, the "contact angle θ" is an angle between the tangent line of a droplet and a solid surface (sheet surface) as illustrated in FIG. 2(*a*), and is shown by the following expression (1).

[Expression 1]

$$\gamma_S=\gamma_L\times\cos\theta+\gamma_{SL} \quad (1)$$

$\gamma_S$: Surface tension of solid $\gamma_L$: Surface tension of liquid $\gamma_{SL}$: Interface tension between solid and liquid Then, the "contact angle θ" can be measured by, for example, the θ/2 method. Specifically, as illustrated in FIG. 2(*b*), the radius r and the height h of a droplet are determined. Then, the contact angle θ is determined from the following expressions (2) and (3).

[Expression 2]

$$\tan\theta_1=\frac{h}{r} \quad (2)$$

[Expression 3]

$$\theta=2\arctan\frac{h}{r} \quad (3)$$

In addition, it is preferable to use, for the curing sheets 10 and 20, a sheet whose water vapor permeability is low, and the water vapor permeability of the sheet is preferably 10 g/m$^2$·24 hours or less and still further preferably 5 g/m$^2$·24 hours or less. In addition, it is preferable to use, for the curing sheets 10 and 20, a sheet whose carbon dioxide permeability is low, and the carbon dioxide permeability of the sheet is preferably 100,000 cc/m$^2$·24 hours·atm or less and still further preferably 50,000 cc/m$^2$·24 hours·atm or less. The surface of the material can be processed by various surface processing techniques to thereby produce a sheet having a reduced water vapor permeability or carbon dioxide permeability.

Now, the method for manufacturing a concrete structure by using each of the curing sheets 10 and 20 having the above configuration will be described. An example using the curing sheet 10 will be described in the following, but the following is also applied to the method using the curing sheet 20.

Figure 3:
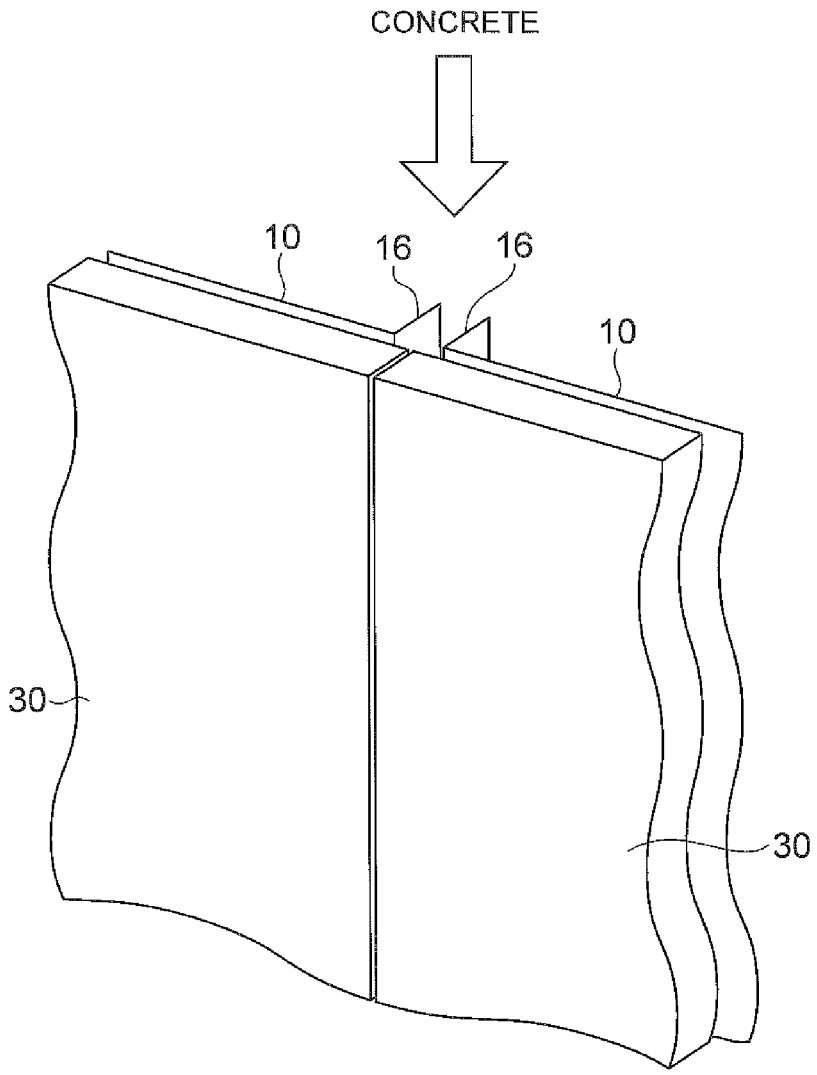
FIG. 3 is a perspective view illustrating a state where the curing sheet is attached to a formwork to start placement in the method for manufacturing a concrete structure.

First, as illustrated in FIG. 3, a curing sheet 10 is attached in advance to the inner surface (namely, a surface to face concrete to be placed) of a formwork 30 for concrete placement by a double-faced tape or the like having pressure-sensitive adhesiveness (curing sheet attachment step), and the formwork 30 is installed at a predetermined position (mold installation step). The formworks 30 are installed with no gap interposed therebetween, but the curing sheets 10 may be installed with a gap of, for example, about 30 to 40 mm interposed therebetween. The reason for this is that it is difficult, in consideration of construction accuracy of the curing sheet 10, to construct end portions 14 of the curing sheet 10 in a linear manner and also to completely match them with end portions of the formwork 30. In order to attach the curing sheet 10 to the formwork 30, for example, surface tension of water may be used, or grease or the like may be used, instead of the double-faced tape. In installation of the formwork 30, protruding portions 16 of the curing sheet 10 attached to the inner surface of the formwork 30 at the boundary portion between the formwork 30 and the formwork 30 adjacent thereto are held in the state of being folded back so as to be substantially perpendicular from the formwork 30 toward a direction where concrete is to be placed. The curing sheet 10 may also be attached to the inner surface of the formwork 30 after the formwork 30 is installed.

Subsequently, once the formwork 30 to which the curing sheet 10 is attached is installed at a predetermined position, concrete C is poured inside of the formworks 30 as indicated by the arrow in FIG. 3 to perform concrete placement (placement step). The placement is performed so that the protruding portions 16 folded back of the curing sheet 10 are embedded in the concrete C. The protruding portions 16 have rigidity so as to be able to have a shape maintained even when embedded in the concrete C, and have a property so as to adhere to the concrete C. These protruding portions 16 are embedded to thereby secure the curing sheet to the concrete C. The curing sheets 10 folded back are located at a predetermined interval, as described above.

Figure 4:
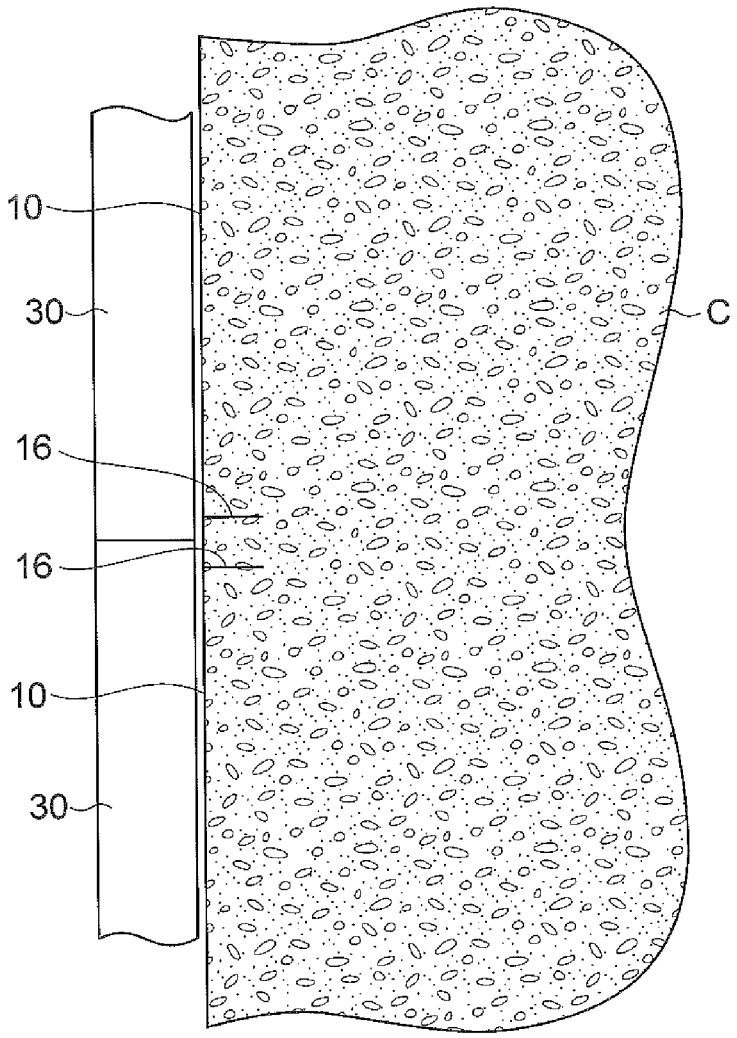
FIG. 4 is a plan view illustrating a state after placement in the method for manufacturing a concrete structure.

Once concrete placement is terminated, fastening is subsequently performed using a vibrator or the like. This allows the concrete C to be sufficiently poured into every corner of the formwork 30 (see FIG. 4). While air bubbles and bleeding water included in concrete float to the surface after concrete placement in a conventional case, generation of air bubbles and bleeding water is suppressed in the present embodiment, since the curing sheet 10 having a contact angle θ equal to or higher than a predetermined angle is provided on a contact portion with the concrete C, as described above. The reason why generation of air bubbles and bleeding water is thus suppressed is believed by the present inventors as follows: when the contact angle θ of the contact surface of the curing sheet 10 covering the concrete surface is higher, the action that pushes water which is included in the concrete and which bleeds to the outside from the surface, and air present in the water back inside the concrete at the sheet contact surface is exerted, and as a result, hardening progresses while water and air therein remain in the concrete C. Specific examples will be described in Examples described later.

Subsequently, once fastening of the concrete is terminated, wet curing of the concrete C is performed for, for example, about 7 days to 28 days while the formwork 30 is fitted, to thereby harden the concrete.

Figure 5:
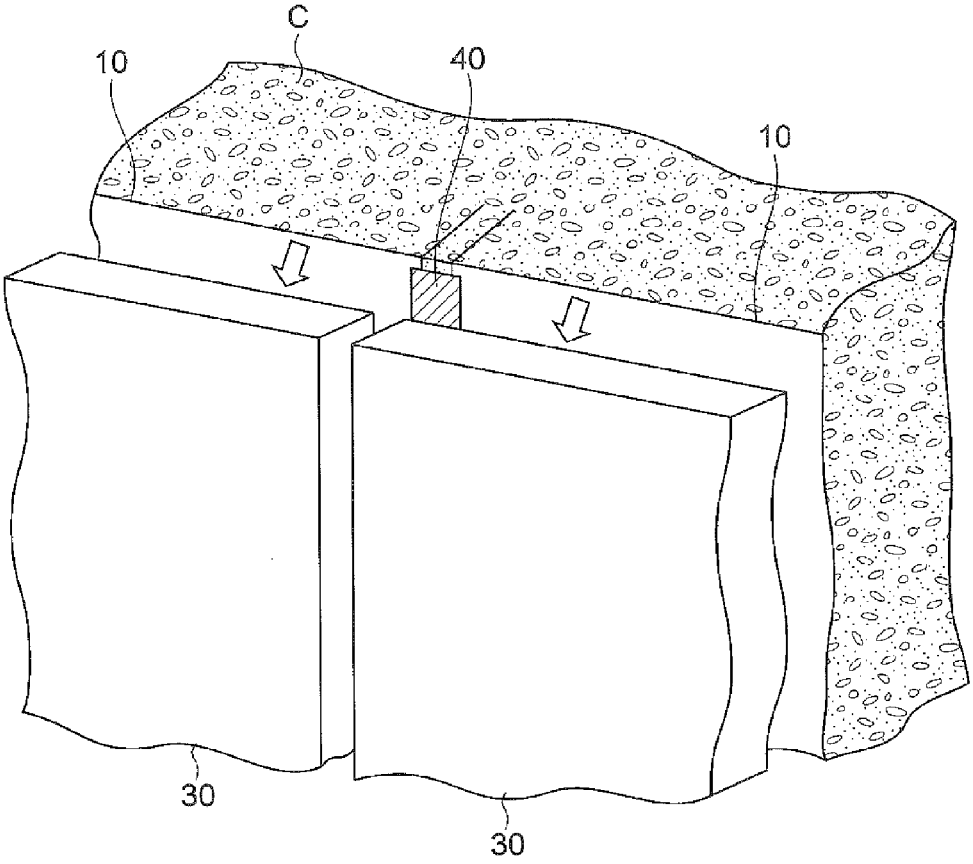
FIG. 5 is a perspective view illustrating a demolding step in the method for manufacturing a concrete structure.
Figure 6:
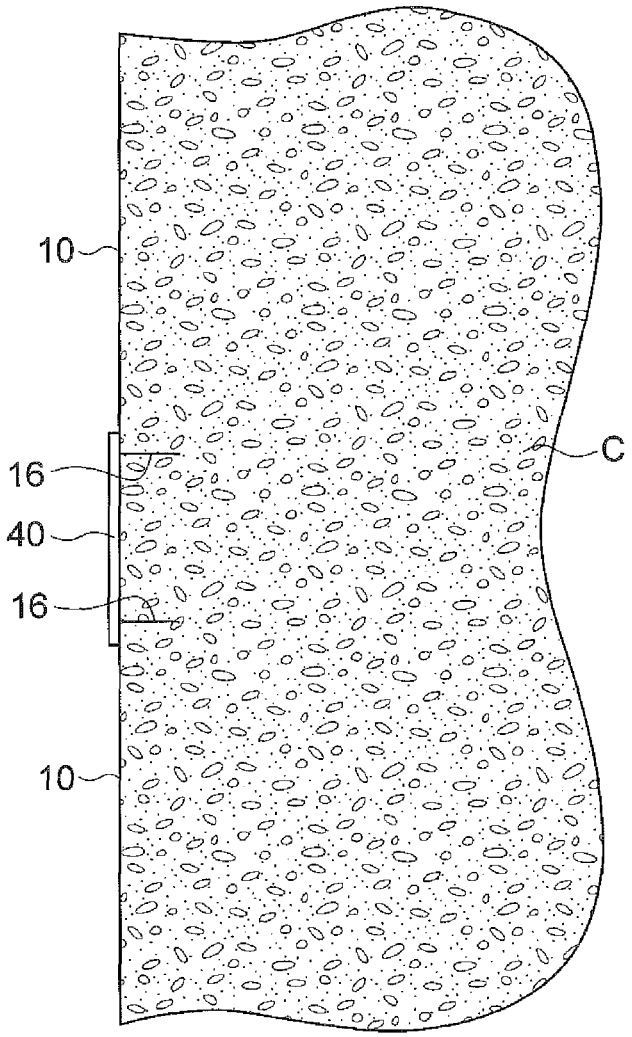
FIG. 6 is a plan view illustrating a state after demolding in the method for manufacturing a concrete structure.

Subsequently, once setting of the concrete C progresses to some extent for hardening, the formwork 30 is removed (demolding step) as illustrated in FIG. 5. The curing sheet 10 attached to the inside of the formwork 30 is attached to the concrete C as it is in demolding. That is, the curing sheet 10 is left as it is. The curing sheet 10 can be left as it is to thereby continue wet curing of the concrete even after the formwork 30 is removed. As described above, the curing sheets 10 are installed with a gap (at the mold boundary portion) and a region where the surface of the concrete C is exposed is also present, and thus a gummed tape 40 (tape member) is attached to the region exposed to prevent dissipation of moisture from the concrete C, as illustrated in FIG. 5. The state where the gummed tape 40 is attached to prevent dissipation of moisture is illustrated in FIG. 6. In removal of the formwork 30, the curing sheet 10 may be released together therewith and the concrete may be covered with other curing sheet. Even in this case, generation of bleeding water is suppressed in initial setting of the concrete, and therefore the same effect as described above can be exerted.

Subsequently, after the formwork 30 is removed, the concrete structure C is cured for a predetermined period using the curing sheet 10 left on the attaching surface of the concrete structure C (curing step). In this curing, the formwork 30 is already removed, and the curing can be continued for a long period as it is without use of any special facilities by only leaving the curing sheet 10 having a sheet shape on the concrete surface. For example, the curing may be continued for 30 days or more after removal of the formwork 30, or the curing may be continued for 90 days or more after removal of the formwork 30. Furthermore, the curing may be, of course, continued until the concrete structure C is passed over (for example, one year or more after demolding). Such long-period of curing can be continued to thereby dramatically increase the strength of the concrete structure C. In the manufacturing method of the present embodiment, since generation of bleeding water is suppressed, water for promoting the hydration reaction is sufficiently included in the concrete C, and therefore curing water for use in the curing may not be separately supplied or such curing water may be supplied in a much smaller amount than that of a conventional case in the curing step.

Figure 7:
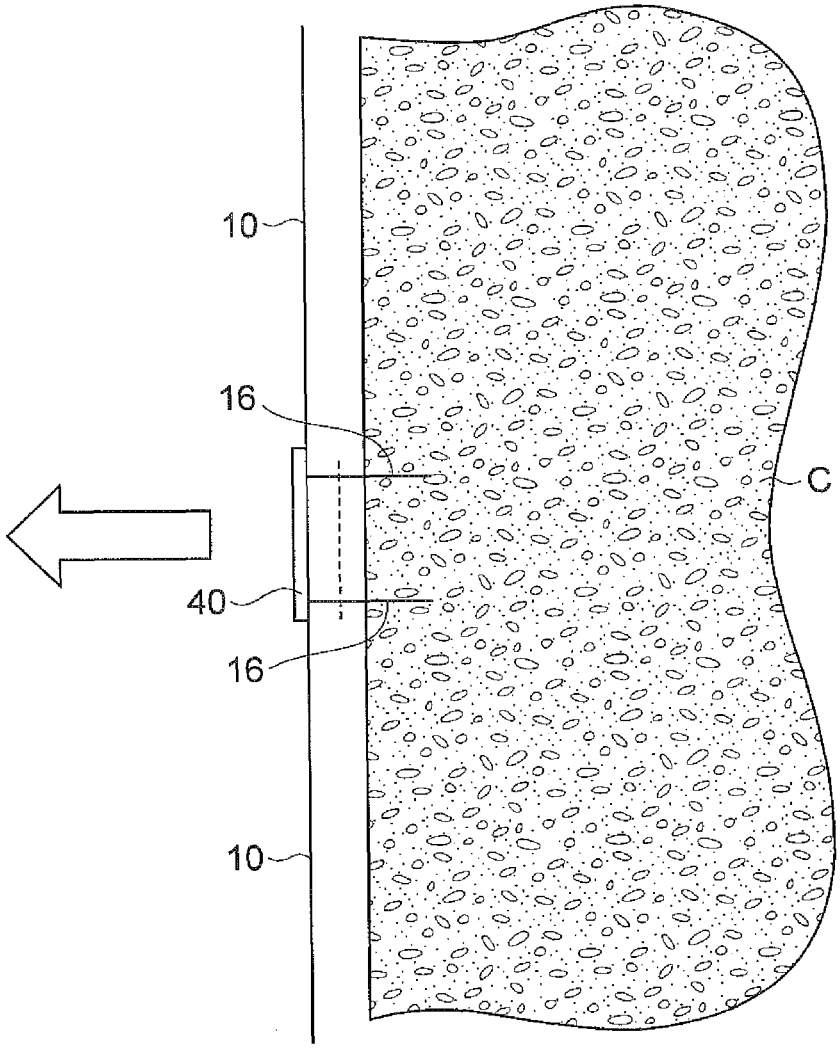
FIG. 7 is a plan view illustrating a curing step in the method for manufacturing a concrete structure.

Thereafter, after a predetermined curing period is terminated, the curing sheets are released from the concrete surface. The gummed tape 40 can be here peeled to thereby pull the curing sheets to allow the protruding portions 16 of the curing sheet 10 to be cut on a dotted line section (see FIG. 7), removing the curing sheet 10 from the concrete structure C. Thus, the concrete structure C is completed.

Hereinabove, according to the manufacturing method of the present embodiment, the curing sheets 10 and 20 having a contact angle with water of 50 degrees or more can be used in placing, thereby effectively suppressing generation of bleeding water usually generated in hardening of concrete C after placing. Then, according to this manufacturing method, since generation of bleeding water is suppressed, the concrete C contains water required for the hydration reaction after demolding, and a concrete structure C that can develop qualities such as predetermined compressive strength and durability can be manufactured without supplying curing water from the outside or using too much curing water in curing of the concrete.

In addition, according to the manufacturing method of the present embodiment, air is inhibited from aggregating on the surface of the concrete C in setting, and therefore the surface texture can become dense and a cover can also be prevented from being partially damaged, to thereby enhance qualities such as compressive strength and durability as compared with a conventional case.

Figure 53:
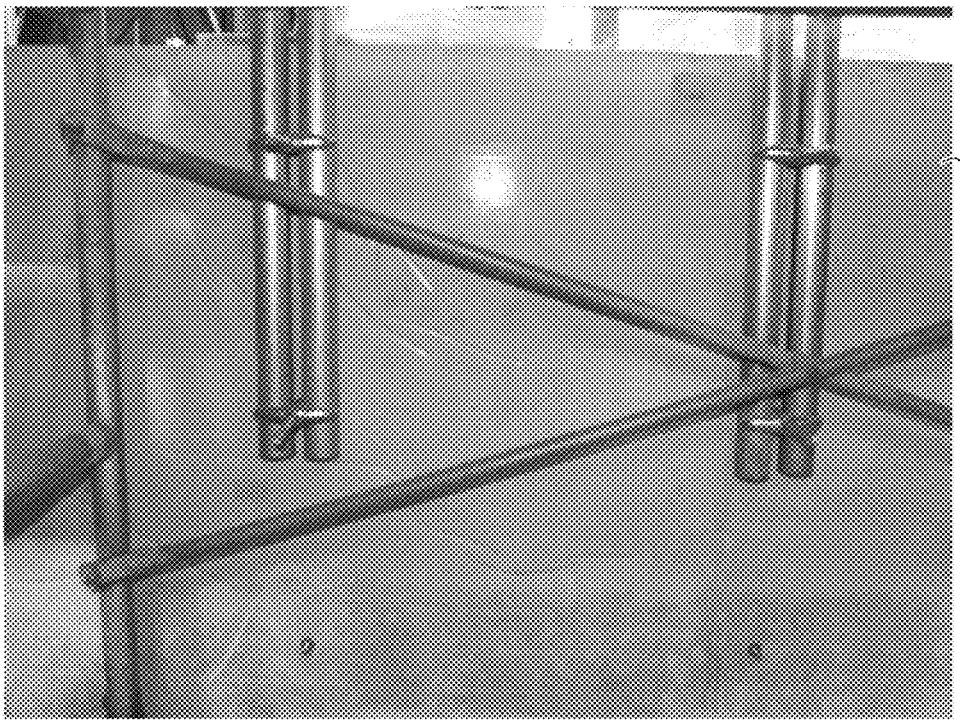
FIG. 53 is an enlarged photograph showing the concrete surface in the comparative test in Examples.

In addition, according to the manufacturing method of the present embodiment, since air in the concrete C is inhibited from aggregating on the surface before demolding, as described above, generation of air bubbles on the surface of the concrete C is suppressed to thereby allow a beautiful concrete structure good in outer appearance to be manufactured (see, for example, FIG. 53). In addition, since the curing sheets 10 and 20 are easily released from the formwork 30 and the concrete C, there is no need to coat the formwork with a release agent, and thereby contamination or stains can be prevented from being generated on the concrete surface by the release agent.

In addition, the manufacturing method of the present embodiment further includes, after the demolding step, a curing step of curing the concrete structure C for a predetermined period with the curing sheet left as it is on an attaching surface of the concrete structure C. The curing sheets 10 and 20 can be used to thereby easily wet cure the concrete C over a long period even after removing the formworks.

In addition, in the manufacturing method of the present embodiment, the contact angle A of the contact surface of each of the curing sheets 10 and 20 for use in the placement step, with water, is more preferably 69 degrees or more, the contact angle θ of the contact surface of each of the curing sheets 10 and 20, with water, is further preferably 80 degrees or more, and the contact angle θ of the contact surface of each of the curing sheets 10 and 20, with water, is still further preferably 90 degrees or more. When the contact angle θ of the contact surface of each of the curing sheets 10 and 20, with water, is thus increased, the action that pushes water which is included in the concrete C and which bleeds to the outside from the surface, and air present in the water back inside the concrete C at the sheet contact surface is more strongly exerted, and therefore water required for the hydration reaction can be sufficiently incorporated to thereby still further enhance qualities such as compressive strength and durability of a concrete structure C to be manufactured.

In addition, in the manufacturing method of the present embodiment, the curing sheets 10 and 20 may be made of the above various materials, but each of these sheets may be a sheet comprising polypropylene, polyethylene terephthalate, polyvinylidene chloride or polyvinyl chloride. In this case, an inexpensive curing sheet can be provided, and the curing sheet can be left on the concrete surface even after demolding to easily make the curing period of the concrete C longer.

In addition, in the manufacturing method of the present embodiment, the thickness of each of the curing sheets 10 and 20 may be 0.05 mm or more. In this case, wrinkles can be hardly generated on the curing sheets 10 and 20 to make the outer appearance of a concrete structure C to be manufactured still more beautiful.

In addition, in the manufacturing method of the present embodiment, the water vapor permeability of each of the curing sheets 10 and 20 may be 10 $g/m^2 \cdot 24$ hours or less, and furthermore the water vapor peg of each of the curing sheets 10 and 20 may be 5 $g/m^2 \cdot 24$ hours or less. In this case, it is possible to further suppress permeation of water required for the hydration reaction to the outside.

In addition, in the manufacturing method of the present embodiment, the carbon dioxide permeability of each of the curing sheets 10 and 20 may be 100,000 $cc/m^2 \cdot 24$ hours·atm or less, and furthermore the carbon dioxide permeability of each of the curing sheets 10 and 20 may be 50,000 $cc/m^2 \cdot 24$ hours·atm or less. In this case, it is possible to suppress ingress of carbon dioxide to the surface of the concrete C in curing to suppress carbonation of the surface of the concrete C.

In addition, in the method for manufacturing a concrete structure according to the present embodiment, although any kind of concrete having a specified design strength of 18 $N/mm^2$ or more and 100 $N/mm^2$ or less can be used, concrete having a specified design strength of 18 $N/mm^2$ or more and 50 $N/mm^2$ or less also may be used, and furthermore concrete having a specified design strength of 18 $N/mm^2$ or more and 33 $N/mm^2$ or less may be used. According to the method of the present embodiment, it is possible to easily take a long curing period, and therefore, by using ordinary concrete whose cost is saved rather than using so-called high strength concrete, a concrete structure having compressive strength and durability which are equal to or higher than those of a conventional structure can be easily manufactured.

The present invention is not limited to the above embodiment, and can be applied to various embodiments. For example, in the above embodiment, the method for manufacturing a concrete structure is described relating to, as an example, the concrete structure C including no reinforcing bar, but a reinforced concrete structure may also be manufactured by the same procedure. In this case, the method for manufacturing a concrete structure further comprises a bar arrangement step of arranging a predetermined reinforcing bar, wherein a reinforced concrete structure is manufactured as the concrete structure. Also in this case, since air bubbles and water generated on the concrete surface are suppressed, a cover thickness can be sufficiently taken, and therefore rust on the reinforcing bar of a reinforced concrete structure to be manufactured can be still further effectively prevented. In addition, since the cover thickness can be more certainly and sufficiently taken than that in a conventional procedure, a design cover thickness can also be thinner than that in a conventional procedure, and the cover thickness can also be thinner to thereby reduce the amount of the concrete for use in the concrete structure while a conventional strength being kept.

Figure 8:
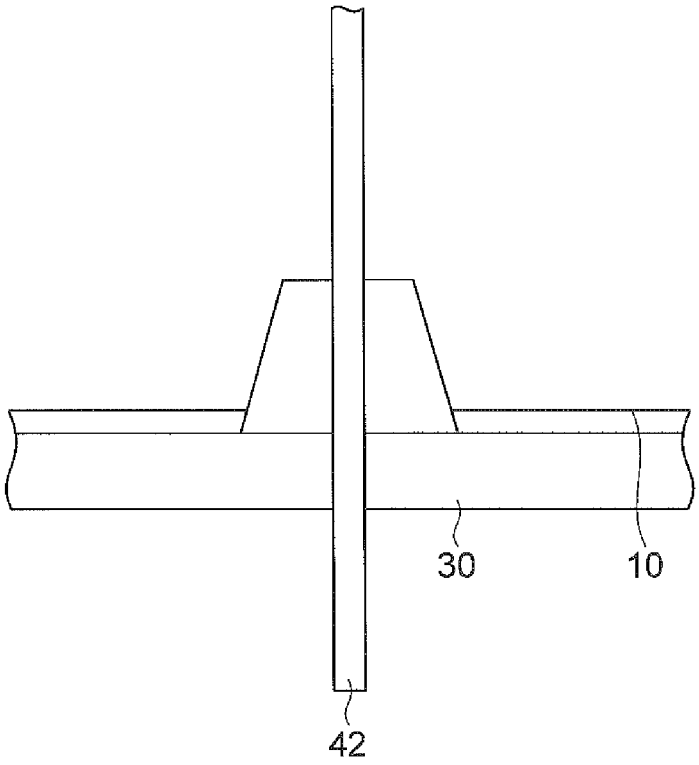
FIG. 8 is a plan view illustrating connecting of a separator in the present embodiment.

In the manufacturing method of the present embodiment, the curing sheets 10 and 20 are easily drilled by an eyeleteer or cut by a saw, and therefore the formworks can be processed using a separator 42 or the like as illustrated in FIG. 8, for example, as with in the case where the curing sheets 10 and 20 are not used.

Figure 9:
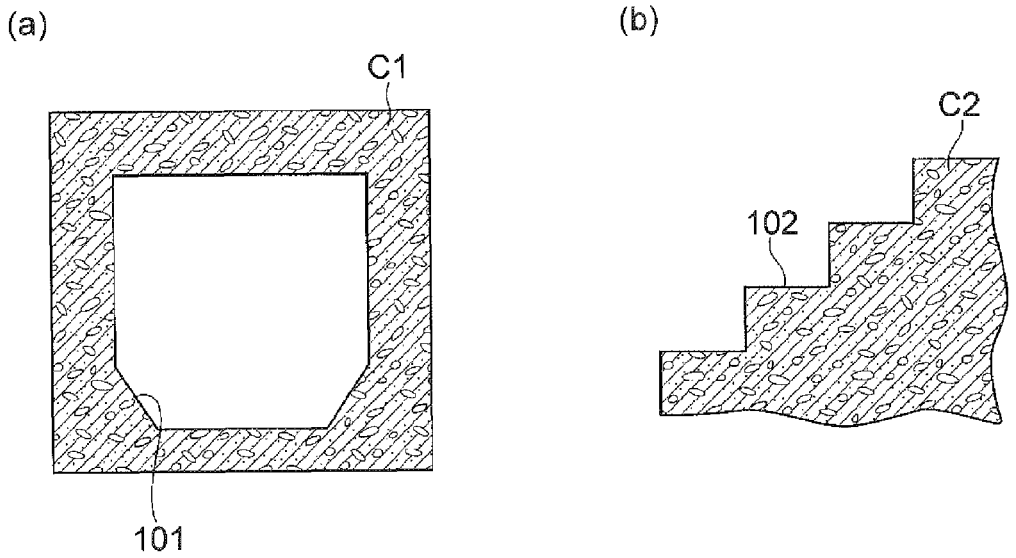
FIG. 9 corresponds to views illustrating an example in which the method for manufacturing a concrete structure according to one embodiment of the present invention is applied to a gradient region, in which FIG. 9(*a*) illustrates a case of application to a haunch portion and FIG. 9(*b*) illustrates a case of application to stairs.

The case where the concrete surface extending in a vertical direction is covered with each of the curing sheets 10 and 20 is described as an example in the above embodiment, and the application range of the present invention is not limited thereto. For example, the present invention may also be applied in formation of a haunch portion 101 of a box culvert C1 as illustrated in FIG. 9(*a*) or a haunch portion of a bridge wall balustrade. The present invention may also be applied in formation of a faceplate 102 of stairs C2 as illustrated in FIG. 9(*b*), namely, a concrete surface extending in a horizontal direction. In this case, when formworks for concrete placement are installed so that a predetermined gradient (for example, 1% or more or 5% or more) is achieved in installation of the formworks, and concrete is placed, concrete placement on a portion having the gradient is performed in the state where the curing sheets 10 and 20 are attached to the inner surfaces of the formworks inclined.

Figure 10:
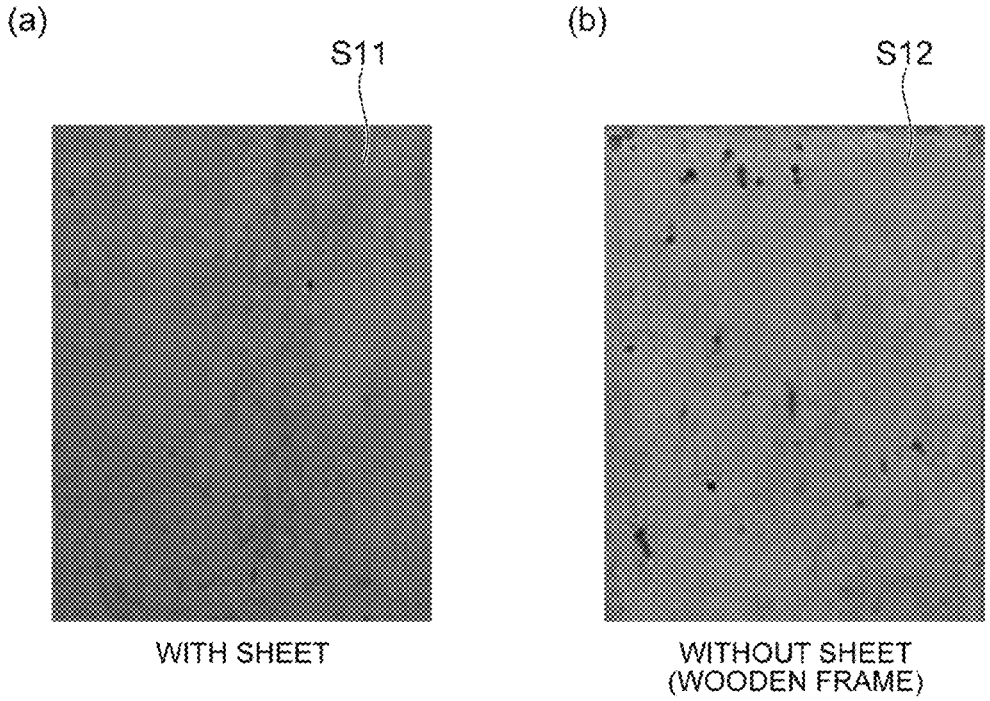
FIG. 10 corresponds to photographs showing the concrete surface of the haunch portion, in which FIG. 10(*a*) illustrates a case of using a sheet according to one embodiment of the present invention and FIG. 10(*b*) illustrates a case of not using the sheet but only a formwork.

When a gradient portion is formed on a concrete structure, it is common that air in concrete is hardly discharged in concrete placement to easily generate surface air bubbles. According to the above method, however, the curing sheets 10 and 20 having a high contact angle are attached to the formworks for gradient portion formation to thereby enable to suppress reaching of air bubbles to a surface portion, reducing generation of surface air bubbles on the gradient portion. FIG. 10 illustrates an example where generation of surface air bubbles on a haunch portion is reduced by one example of the present invention. FIG. 10(*b*) shows a case where a haunch portion S12 is formed by only a formwork (wooden frame) without a curing sheet, and FIG. 10(*a*) shows a case where the curing sheet having a contact angle of 50 degrees or more of the present invention is attached to a formwork to form a haunch portion S11. As is clear from comparison of these photographs, in the case where the curing sheet having a contact angle of 50 degrees or more is used (the case in FIG. 10(*a*)), generation of air bubbles on the surface of the haunch portion S11 formed is suppressed.

While a general method for manufacturing a concrete structure is exemplified in the above embodiment, the present invention may also be applied to, for example, the invert of an aqueduct tunnel made of concrete. In this case, the surface hardness of a concrete structure can be enhanced, and therefore the present invention can be applied to the invert of an aqueduct tunnel to thereby easily enhance long-period durability of an invert hard to repair, or the like. Formation of such an invert can be realized by disposing each of the above curing sheets 10 and 20 so that the surface of the invert portion is covered with these sheets in concrete placement, to perform placement or curing.

The present invention may also be applied to a reduction in the cross section of a water passage. Specifically, when a concrete structure is manufactured using each of the curing sheets 10 and 20, the roughness coefficient of the surface thereof can be easily enhanced from 0.015, which is a common roughness coefficient, to 0.013 or the like, and therefore, when, for example, a conventional aqueduct tunnel having a diameter of 5 m has a gradient of 1% in a ½ water depth (the water depth corresponds to ½ the diameter), the diameter of the cross section of the water passage can also be reduced to 4.73 m in order to ensure a flow passage subequal thereto. Such calculation can be made using the Manning's equation or the like.

Figure 11:
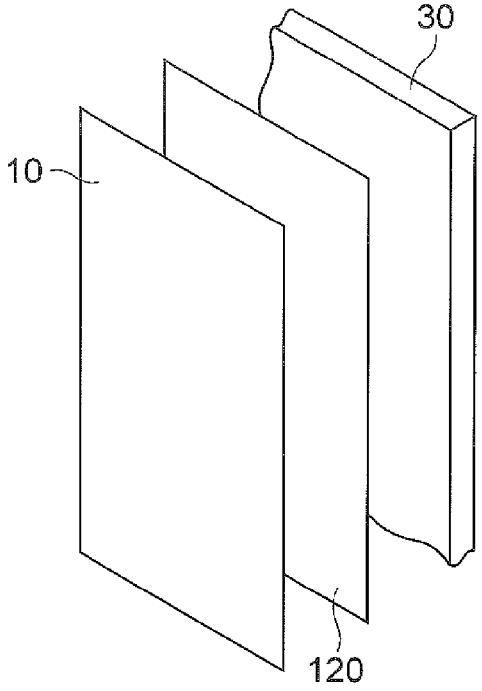
FIG. 11 corresponds to views illustrating a case of use of a heat insulation material in the method for manufacturing a concrete structure, in which FIG. 11(*a*) illustrates mold installation and FIG. 11(*b*) illustrates demolding.
Figure 11:
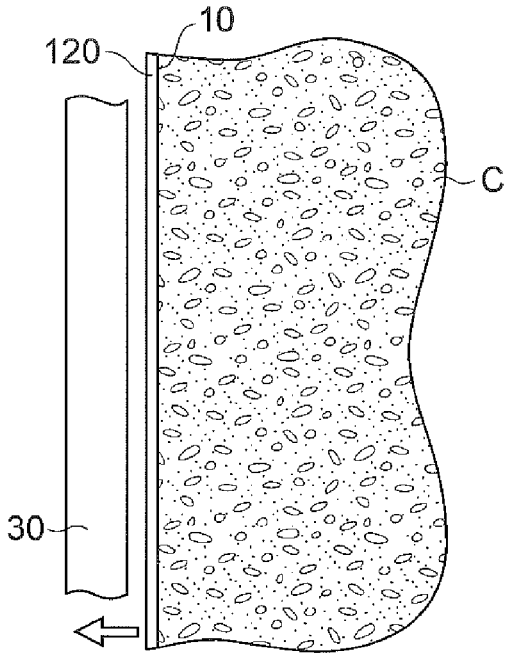
Figure 12:
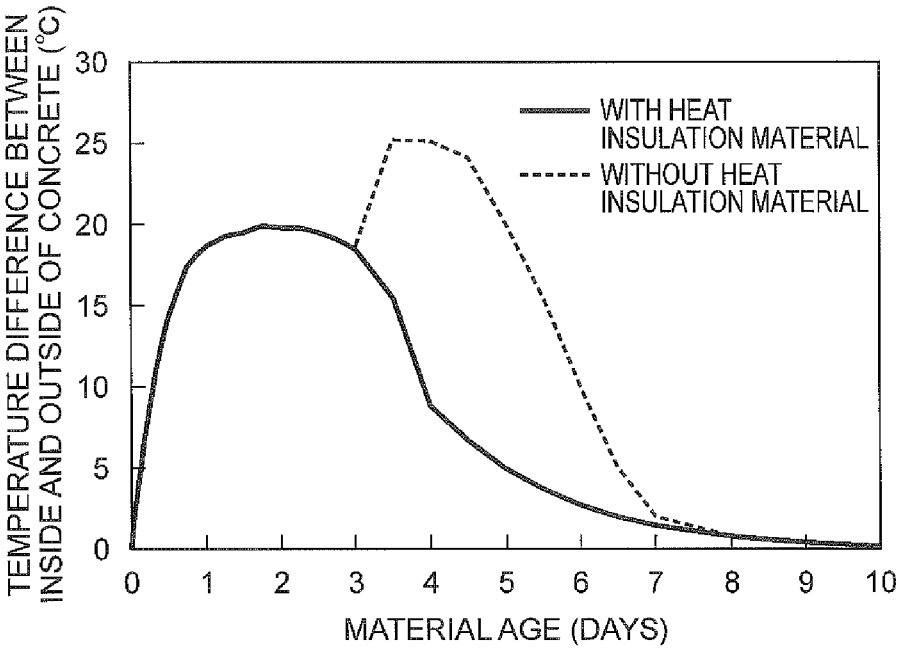
FIG. 12 is a graph showing the temperature difference between the inside and the outside of concrete in each of a case where a heat insulation material is used and a case where a heat insulation material is not used.

Though a heat insulation material is not used in order to reserve heat of the concrete surface in the above embodiment, a heat insulation material may also be used for a technique of suppressing temperature cracking of concrete or of heat insulating curing in winter. For example, when a heat insulation material is not used as shown in FIG. 12, temperature cracking and the like of concrete may be caused due to a rapid increase in the temperature difference between the inside and the outside in demolding (in the Figure, material age: 3 days). As illustrated in FIG. 11(*a*), however, a heat insulation material 120 is disposed between a curing sheet 10 and a formwork 30 in attachment of the curing sheet 10 to the formwork 30, and concrete placement may be performed in a state where the heat insulation material 120 is disposed between the curing sheet 10 and the formwork 30 in attachment of the curing sheet 10 to the formwork 30. Then, as illustrated in FIG. 11(*b*), the formwork 30 is removed while the heat insulation material 120 is left on the surface of a concrete structure C in demolding.

This makes it possible to gradually reduce the temperature difference between the inside and the outside as shown in the graph "WITH HEAT INSULATION MATERIAL" in FIG. 12, and to prevent rapid cooling until the heat insulation material is attached as compared with a case where a heat insulation material is separately attached after demolding. In addition, it is also possible to remove the formwork earlier than a case where a heat insulating formwork is used. As a result, the method according to the present invention in which the heat insulation material is further used enables to prevent temperature cracking and the like of concrete while enabling early removal of the formwork. It is preferable that the heat insulation material used here have a surface heat transfer coefficient of, for example, 8 $W/m^{2\circ}$ C. or less.

While the curing sheets 10 and 20 are not coated with a surface modifier or the like in the above embodiment, the curing sheets 10 and 20 may also be further coated with a surface modifier or the like. Specifically, surfaces facing concrete placed of the curing sheets 10 and 20 are coated with at least one of a surface modifier, a shrinkage reducer, a water absorption inhibitor and a release agent to perform concrete placement. This enables to impart not only smoothing and moisturizing of the surfaces, but also an additional effect by the agent used for coating, on the concrete structure. For example, when a surface modifier including an alkaline silicate or a cement type compound is used, silica gel or C—S—H (calcium-silicate hydrate) can be produced on the concrete surface to make the concrete texture dense.

When a shrinkage reducer including an alcohol type compound is used, the action of a surfactant can suppress the negative pressure generated in pore voids of concrete to reduce drying shrinkage and the like. When a water absorption inhibitor including a silane type compound is used, a water absorption preventing layer can be formed on the concrete surface to thereby suppress freezing damage. When an oily or aqueous release agent is used, releasability (ease of release) of concrete can be still further enhanced to provide a denser concrete surface. The above agents may be used singly or in combinations of a plurality thereof.

[Providing Operation Method of Curing Sheet into Formwork, and Holding System]

Here, an operation method of providing a curing sheet into a formwork, which can be applied to the method for manufacturing a concrete structure according to the present invention, and a holding system of the curing sheet, which can be used in the operation method, will be described.

First, the holding system for use in the method for manufacturing a concrete structure is described with reference to FIG. 13 and FIG. 14. A holding system 201 includes a placing-side formwork 210 that is disposed at a side of concrete placement, an outside formwork 220 that is disposed opposite to the placing-side formwork 210, a curing sheet 230 that cures placed concrete, and a suction member including an air hose 240 and a suction pump. The curing sheet 230 is the same as the curing sheet 30 described above.

The placing-side formwork 210 is a formwork that is disposed at the side of the placement in placement of the concrete C, and a plurality of openings 212 are formed thereon. The openings 212 are, for example, fine through-holes having a diameter of about 1 to 5 mm, and disposed in line so as to have a pitch of about 8 to 10 mm as the distances from other adjacent openings 212. The placing-side formwork 210 is made of, for example, a steel formwork (metal form) or a plastic formwork.

The outside formwork 220 is disposed outside (opposite to concrete placed) and in parallel with the placing-side formwork 210, so as to be opposite thereto. A through-hole 222 for connection of an air hose 240 is formed in the outside formwork 220, and the air hose 240 is mounted to the outside formwork 220 so that the through-hole 222 can be kept in an airtight state. The air hose 240 is mounted to a suction pump not illustrated. The outside formwork 220 includes, for example, a steel formwork (metal form), a plastic formwork or the like as with the placing-side formwork 210.

Figure 14:
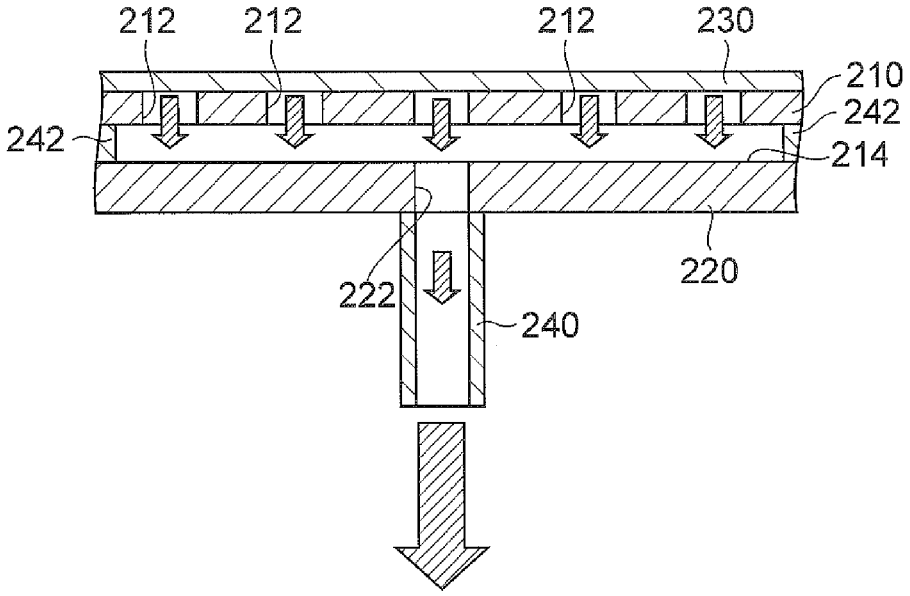
FIG. 14 is a transverse cross-sectional view illustrating the cross section of the holding system illustrated in FIG. 13.

The placing-side formwork 210 and the outside formwork 220 are bound to each other so that four sides of each thereof can be kept in an airtight state by a sealing member 242 in concrete placement, and an internal void 214 is formed therein, as illustrated in FIG. 14. For the sealing member 242, for example, a gasket, packing or the like having a quadrangular outer shape and made of a rubber or the like, can be used.

Next, a method for manufacturing a concrete structure using the holding system 201 having the above configuration will be described.

Figure 13:
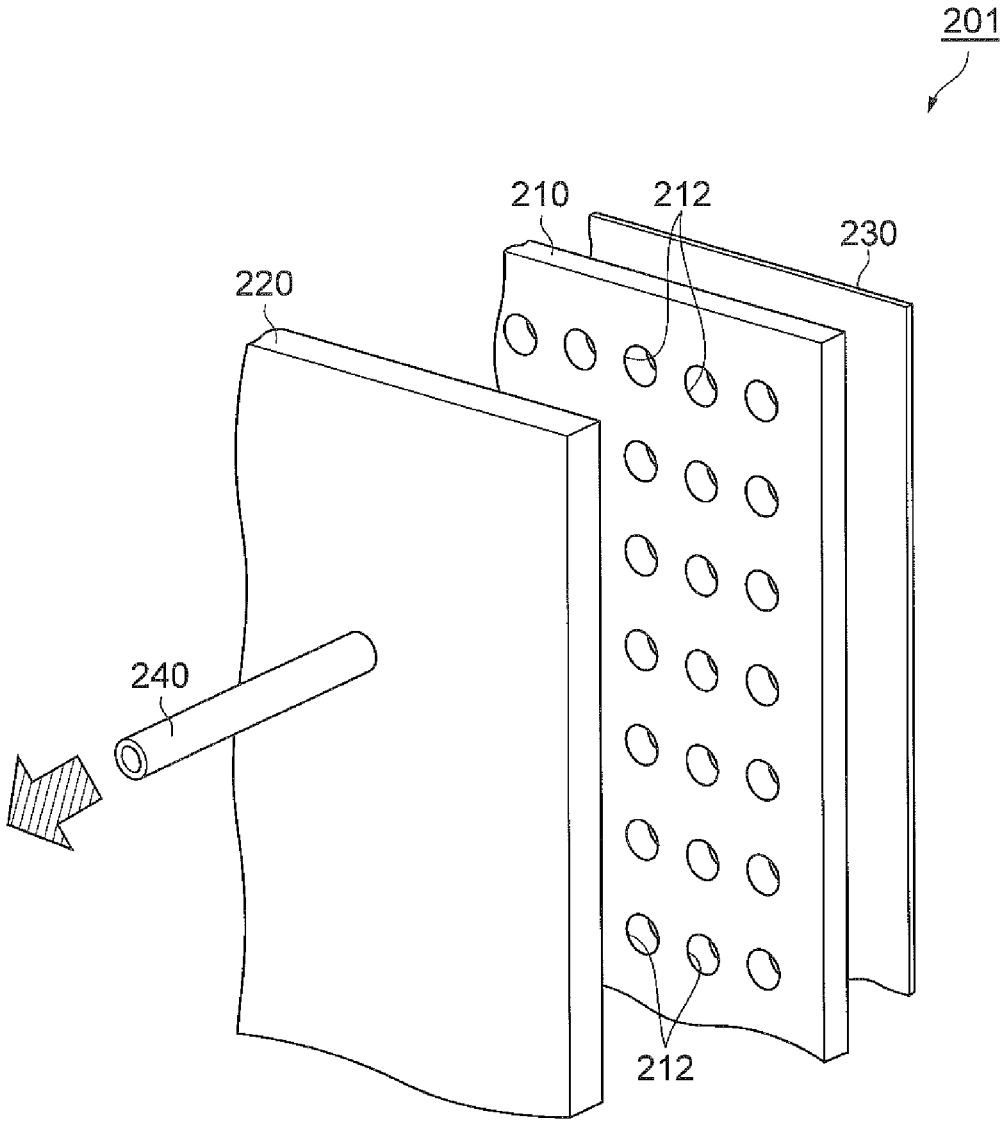
FIG. 13 is a perspective view schematically illustrating one example of a holding system of a concrete curing sheet.

First, as illustrated in FIG. 13 and FIG. 14, formworks 210 and 220 for concrete placement, and a curing sheet 230 are provided. In addition, the placing-side formwork 210 and the outside formwork 220 are bound to each other via a sealing member 242 to allow airtight between the formworks 210 and 220 to be kept. Thus, an internal void 214 is formed between the formworks 210 and 220.

Subsequently, a curing sheet 230 is mounted on a surface of the placing-side formwork 210, the surface being facing concrete placed, so as to cover all of a plurality of openings 212 of the placing-side formwork 210 airtightly bound to the outside formwork 220. Then, air is sucked by a suction pump via an air hose 240 mounted to the outside formwork 220 so that the atmospheric pressure in this internal void 214 is reduced.

Figure 15:
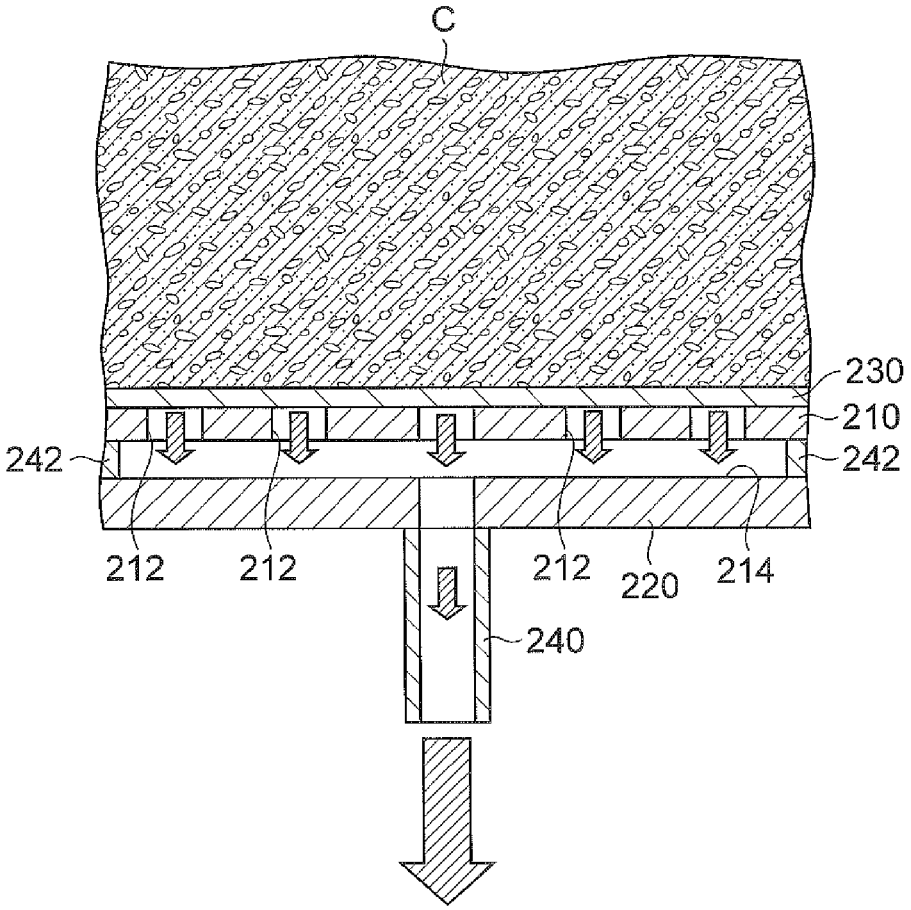
FIG. 15 is a transverse cross-sectional view illustrating a state after performance of concrete placement in the holding system illustrated in FIG. 14.

Subsequently, as illustrated in FIG. 15, concrete C is placed in the state where the curing sheet 230 is attached to the placing-side formwork 210 of the formworks 210 and 220 subjected to pressure reduction by the air hose 240 and the suction pump. The curing sheet 230 has a thickness of, for example, 0.05 mm or more, and therefore the sheet is inhibited from being creased even when concrete is placed. Once concrete placement is terminated, sucking by the suction pump is stopped, and an air valve is closed which is provided on the air hose 240 so as to keep the internal void 214 under reduced pressure.

Subsequently, once concrete placement is terminated, fastening is performed using a vibrator or the like. This allows the concrete C to be sufficiently poured into every corner of the formworks 210 and 220. The curing sheet 230 is the same as the curing sheet 30, and therefore generation of air bubbles and bleeding water is suppressed.

Subsequently, once fastening of concrete is terminated, wet curing of the concrete C is performed for, for example, about 7 days to 28 days while the formworks 210 and 220 are fitted, to thereby harden the concrete.

Figure 16:
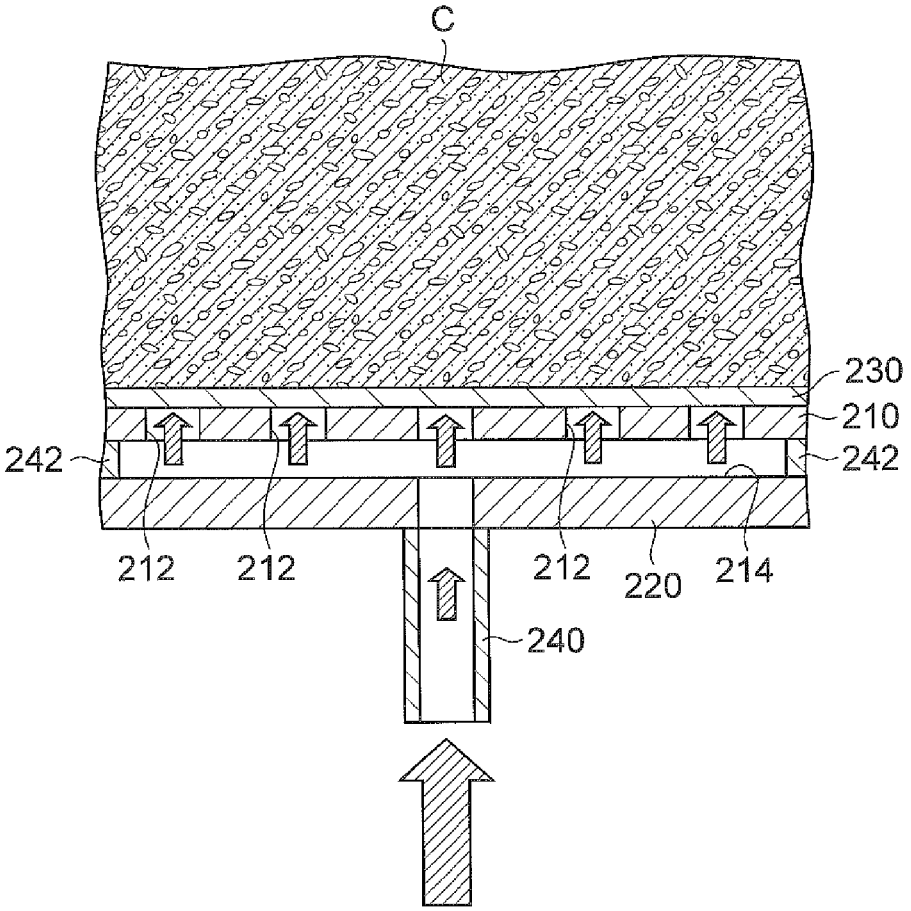
FIG. 16 is a transverse cross-sectional view illustrating a state where securing of the curing sheet is released in the holding system illustrated in FIG. 15.
Figure 17:
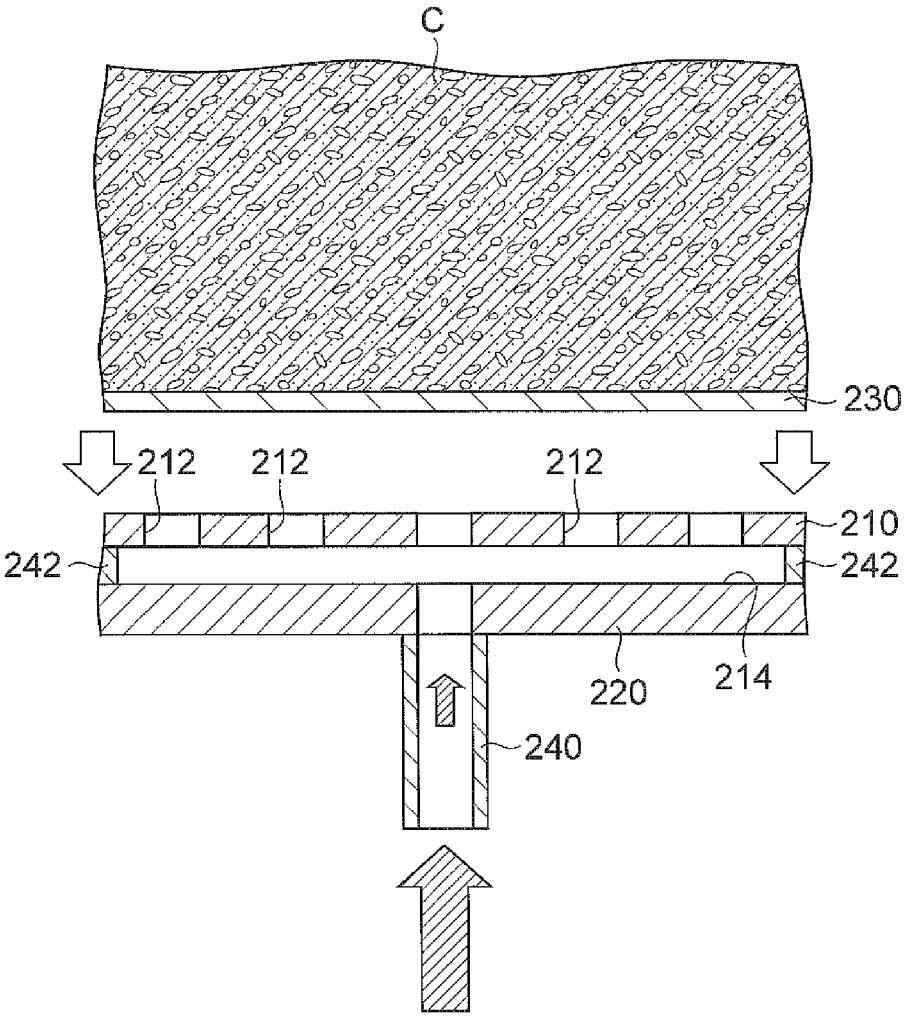
FIG. 17 is a transverse cross-sectional view illustrating a state where the formwork is removed in the holding system illustrated in FIG. 16.

Subsequently, once setting of the concrete C progresses to some extent for hardening, the formworks 210 and 220 are removed as illustrated in FIG. 16 and FIG. 17. In demolding, first, as illustrated in FIG. 16, the air valve provided on the air hose 240 is opened in order that the internal void 214 under reduced pressure is opened. This lifts the state where the formwork 210 and the curing sheet 230 are attached. Then, after the state where the formwork 210 and the curing sheet 230 are attached is lifted, the formworks 210 and 220 are removed to be separated from the concrete C, as illustrated in FIG. 17. The curing sheet 230 here is left on an attaching surface of the concrete structure C.

Subsequently, after the formworks 210 and 220 are removed, the curing sheet 230 left on the attaching surface of the concrete structure C is used to cure the concrete structure C for a predetermined period. Thereafter, the curing sheet 230 is released from the concrete surface after a predetermined curing period is terminated. Thus, the concrete structure C is completed.

Hereinabove, in the above providing operation method, the curing sheet 230 is attached to the formwork 210 by providing the plurality of openings 212 on a surface of each of the formworks 210 and 220, the surface being facing the concrete placed, and providing the internal void 214 linked to the openings 212 to reduce the atmospheric pressure in the internal void 214. Thus, the curing sheet 230 may only be mounted along the formwork 210 and subjected to pressure reduction, and therefore an operation of purposely attaching the formwork 210 and the curing sheet 230 by a double-faced tape or the like can be omitted to make the providing operation of the curing sheet 230 efficient.

In addition, in this providing operation method, the suction member is mounted to the formwork 220, and air in the internal void 214 is sucked by the suction member to thereby reduce the atmospheric pressure in the internal void 214 in the pressure reduction step. Thus, the atmospheric pressure in the internal void 214 in each of the formworks 210 and 220 can be reduced by a simple configuration.

[Other Providing Operation Method and Holding System]

Next, other examples of the operation method of providing the curing sheet to the formwork, which can be applied to the method for manufacturing a concrete structure according to the present invention, and a holding system of the curing sheet, which can be used in the operation method, will be described with a focus on the difference with the above description.

Figure 18:
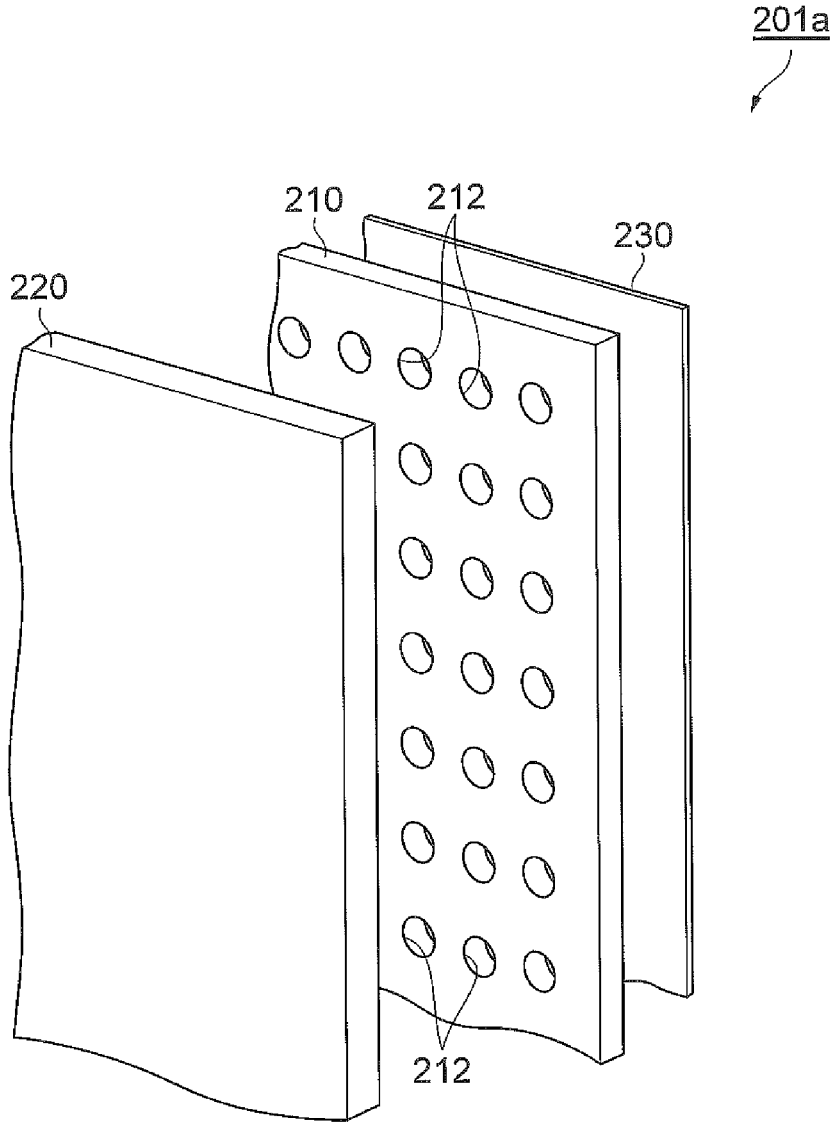
FIG. 18 is a perspective view schematically illustrating another example of the holding system of the concrete curing sheet.
Figure 19:
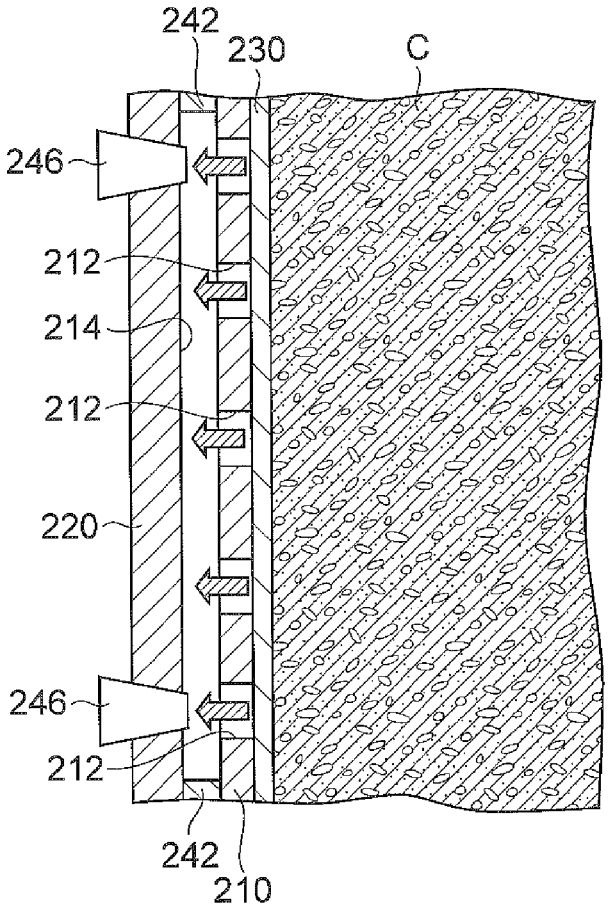
FIG. 19 is a vertical cross-sectional view illustrating a state after concrete placement is performed in the holding system illustrated in FIG. 18.

First, the holding system will be described with reference to FIG. 18 and, FIG. 19. A holding system 201*a* includes a placing-side formwork 210 that is disposed at a side of concrete placement, an outside formwork 220 that is disposed opposite to the placing-side formwork 210, a curing sheet 230 that cures placed concrete, and a suction member including an atmospheric pressure valve 246. The atmospheric pressure valve 246 is a device that is airtightly disposed so as to be linked to an internal void 214 in each of the formworks 210 and 220 and that allows the inside of the internal void 214 to be under negative pressure (reduced pressure) by closing the valve.

Figure 20:
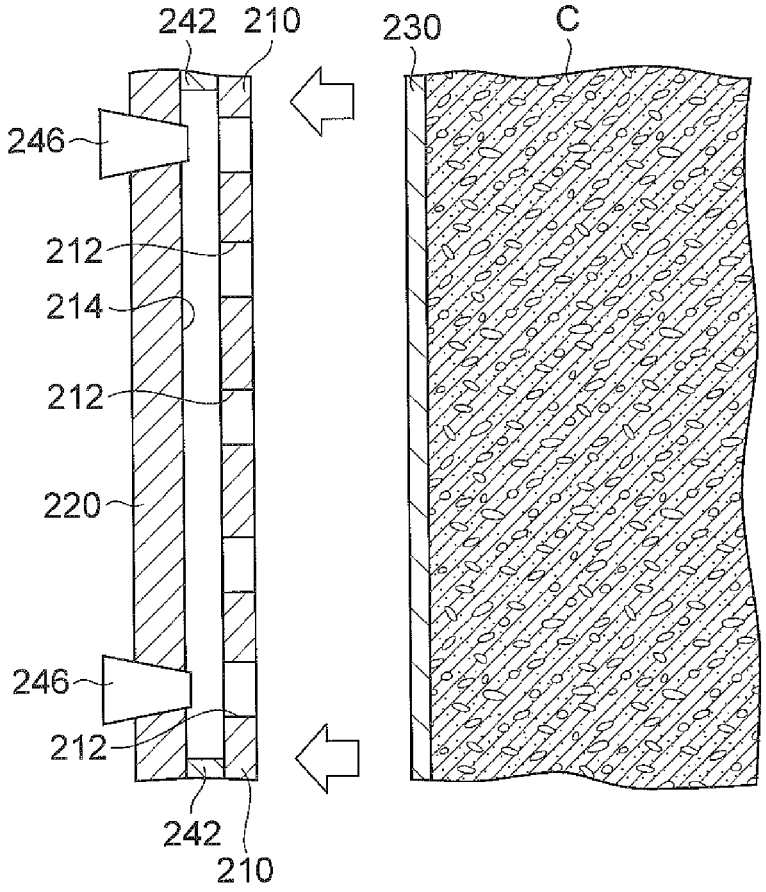
FIG. 20 is a vertical cross-sectional view illustrating a state where the formwork is removed in the holding system illustrated in FIG. 19.

While a method for manufacturing a concrete structure C using the holding system 201*a* having such a configuration is the same as described above, pressure reduction is performed by closing the atmospheric pressure valve 246 to thereby allow the internal void 214 to be under negative pressure in the pressure reduction step, instead of sucking by the suction pump. In addition, in the demolding step, in order to lift the state where the formwork 210 and the curing sheet 230 are attached, the atmospheric pressure valve 246 is opened to thereby allow the internal void 214 to be at ordinary pressure, and thereafter the formworks 210 and 220 are removed and separated from the concrete C as illustrated in FIG. 20. The curing sheet 230 is left on an attaching surface of the concrete structure C, as with the above.

Hereinabove, also in this case, the curing sheet 230 is attached to the formwork 210 by providing the plurality of openings 212 on a surface of each of the formworks 210 and 220, the surface being facing concrete placed, and providing the internal void 214 linked to the openings 212 to reduce the atmospheric pressure (to the negative pressure) in the internal void 214. Thus, the curing sheet 230 may only be mounted along the formwork 210 and subjected to pressure reduction, and thus an operation of purposely attaching the formwork 210 and the curing sheet 230 by a double-faced tape or the like can be omitted to make the providing operation of the curing sheet 230 efficient. Other effects are substantially the same as the above case, but in this case, the atmospheric pressure valve 246 as a simper suction member can be used to thereby more easily perform the operation on-site.

Next, a method of leaving a curing sheet on concrete, which can be applied to the method for manufacturing a concrete structure according to the present invention, will be described with reference to the drawings. In this method of leaving a curing sheet, a predetermined holding device is used. The curing sheet used here is substantially the same as the curing sheet 30 described above.

[First Modification]

Figure 21:
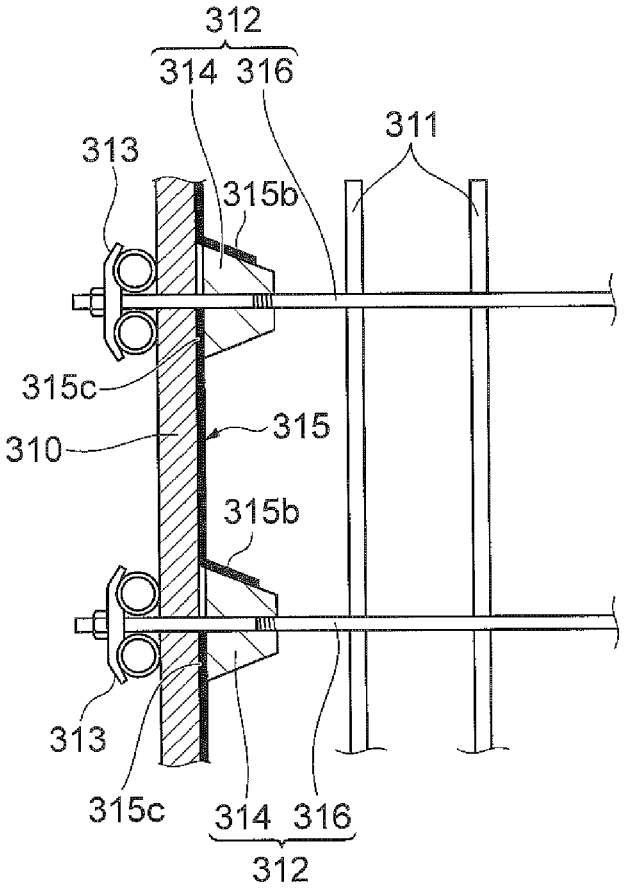
FIG. 21 is a view for explaining a mold installation step of a first modification for leaving the curing sheet on the concrete.

In a method for manufacturing a concrete structure according to a first modification, first, as illustrated in FIG. 21, a mold installation step of installing a formwork 310 for concrete placement, a reinforcing bar 311, a gap holding material 312 (including a cone 314 and a separator 316), a Form Tie (registered trademark) 313, a curing sheet 315 and the like at predetermined positions is performed. The curing sheet 315 is disposed on the inner surface (namely, a surface to face concrete placed) of the formwork 310 in advance. The curing sheet 315 may also be disposed on the inner surface of the formwork 310 after the formwork 310 is installed. The curing sheet 315 is the same as the curing sheet 30. The curing sheet 315 is retained by being partially tucked between the cone 314 and the formwork 310 as illustrated in FIG. 21.

The separator 316 is provided at a predetermined interval in order to prevent bowing of the formwork 310 in concrete placement, and the end portion thereof projects to the outside while penetrating through the curing sheet 315 and the formwork 310. The Form Tie 313 that grasps the separator 316 to restrain bowing deformation of the formwork 310 is provided outside the formwork 310. The Form Tie 313 holds a pair of pipes disposed along the formwork 310.

The gap holding material 312 has the separator 316, and a resin cone 314 having a truncated cone shape. An external thread is formed on the end portion of the separator 316, and screwed into an internal thread in the cone 314 to be secured to each other. A bar portion is provided on the cone 314 so as to elongate a separator bar portion 316, and this bar portion projects to the outside while penetrating through the curing sheet 315 and the formwork 310. An external thread is formed on the tip of the bar portion projecting to the outside, and a nut portion of the Form Tie 313 is screwed into this external thread.

The gap holding material 312 may include a cone made of a metal or other material instead of the resin cone 314. The cone 314 does not necessarily have a truncated cone shape (cone shape), and may have any shape that can be expanded in the width direction of the separator bar portion 316 to be in surface contact with the formwork 310.

Figure 22:
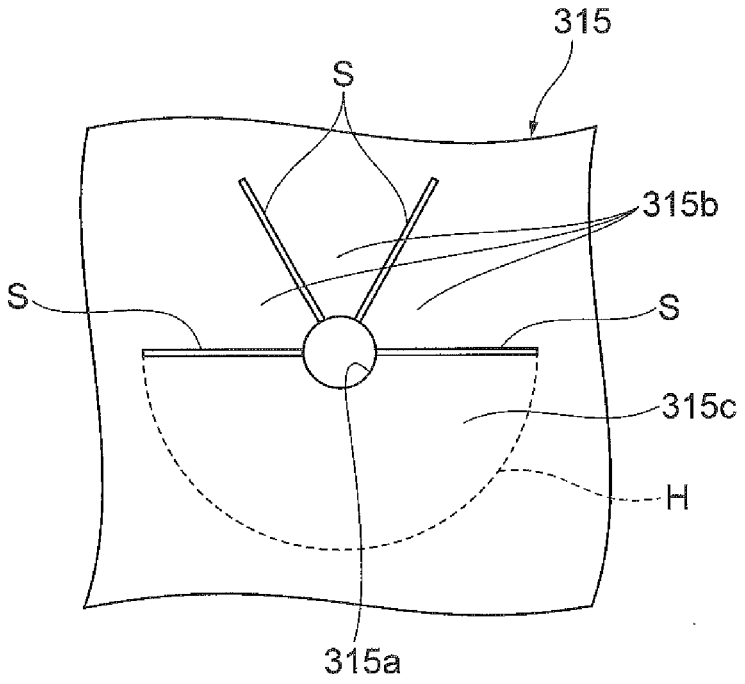
FIG. 22 is a view illustrating a hole for a separator formed in the curing sheet.

FIG. 22 is a view illustrating a separator hole 315*a* provided in the curing sheet 315. As illustrated in FIG. 22, a plurality of incisions S are radially made on an upper portion 315*b* of the separator hole 315*a* through which the separator 316 penetrates, and are formed so that respective portions can be turned up. A cutoff line H is formed in a semicircle on a lower portion 315*c* of the separator hole 315*a*.

As illustrated in FIG. 21, the upper portion 315*b* of the separator hole 315*a* is turned up so as to be located on the cone 314, and thus the curing sheet 315 is partially folded inside (to face concrete placed). The lower portion 315*c* of the separator hole 315*a* is tucked between the cone 314 and the formwork 310.

Figure 23:
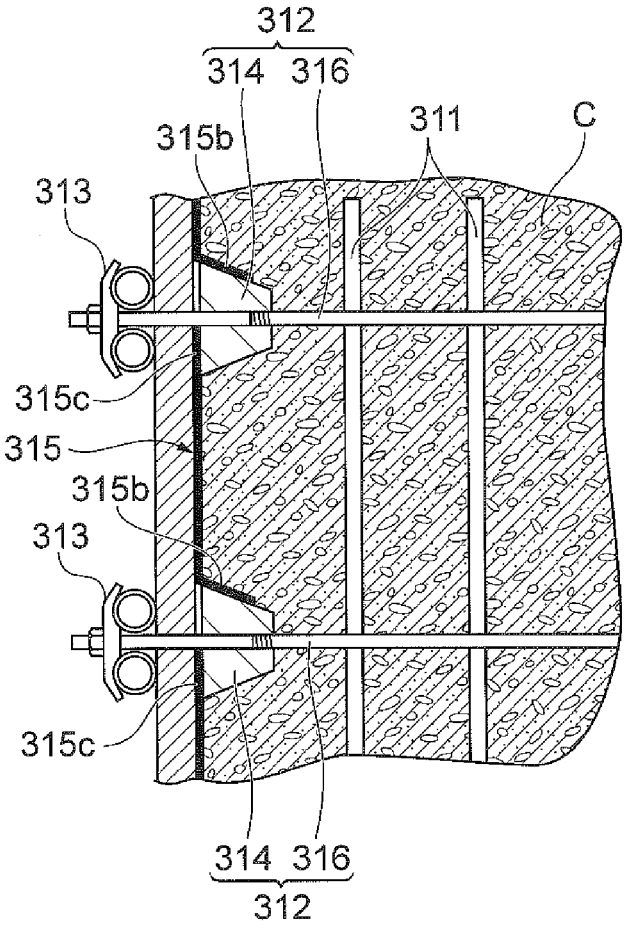
FIG. 23 is a view for explaining a placement step of the first modification.

FIG. 23 is a view for explaining a placement step in the first modification. As illustrated in FIG. 23, once the formwork 310 and the like are installed at predetermined positions, a concrete placement step of pouring concrete C into the formwork 310 is performed. In this placement step, concrete is placed in the state where the upper portion 315*b* of the curing sheet 315 is folded inside.

Once concrete placement is terminated, subsequently, fastening is performed using a vibrator or the like. This allows the concrete C to be sufficiently poured into every corner of the formwork 310. While air bubbles and bleeding water included in concrete float to the surface after concrete placement in a conventional case, generation of air bubbles and bleeding water is suppressed in the present embodiment as described above, since the curing sheet 315 is provided on a contact portion thereof with the concrete C. Once fastening of the concrete is terminated, wet curing of the concrete C is performed for, for example, about 7 days to 28 days while the formwork 310 is fitted, to thereby harden the concrete C.

Since concrete C is here placed in the state where the upper portion 315*b* of the curing sheet 315 is folded inside, the upper portion 315*b* of the curing sheet 315 is sandwiched between the cone 314 and concrete C by hardening of the concrete C. The upper portion 315*b* of the curing sheet 315 is in the state where the periphery thereof, except for a surface facing the cone 314, is surrounded by the concrete C. Thus, the upper portion 315*b* is stuck to the concrete C by hardening of the concrete C, and the curing sheet 315 is avoided from being easily peeled off from concrete C. Even in the case where the inner surface of the curing sheet 315 is coated with a release agent, it is desirable not to coat the upper portion 315*b* with a release agent.

Figure 24:
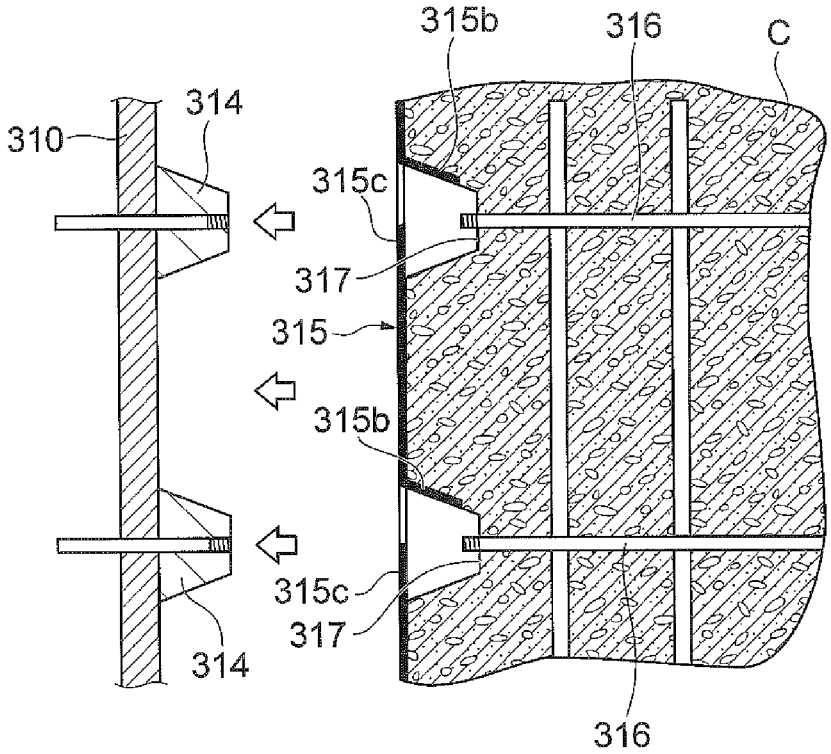
FIG. 24 is a view for explaining a demolding step of the first modification.

FIG. 24 is a view for explaining a demolding step in the first modification. As illustrated in FIG. 24, once setting of the concrete C progresses to some extent for hardening, the demolding step of removing the formwork 310 is performed. In demolding, the cone 314 of the gap holding material 312 is also removed from the concrete C. A hole 317 is formed in a trace of removing the cone 314, and the end portion of the separator 316 is exposed to the bottom of the hole 317. The upper portion 315*b* of the curing sheet 315 is here stuck to the concrete C, and thus the curing sheet 315 is avoided from being peeled off in removal of the cone 314. The lower portion 315*c* of the curing sheet 315 may be cut off in removal of the cone 314, or may be pulled out from between the formwork 310 and the cone 314 and left. In the case of pulling out, incisions S are provided as in the upper portion 315*b* in FIG. 22 to thereby facilitate the operation. The case where the lower portion 315*c* is left as illustrated in FIG. 24 is here described.

Figure 25:
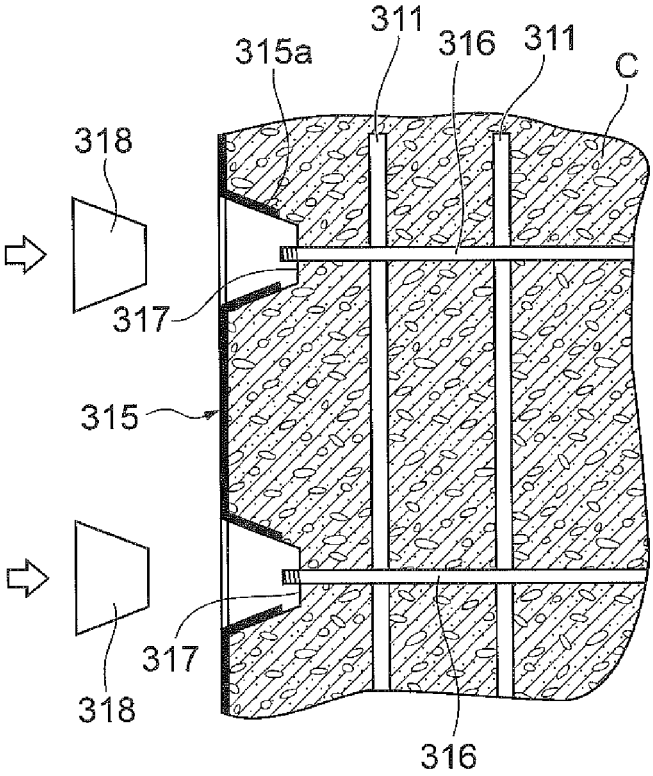
FIG. 25 is a view for explaining an embedding step of the first modification.

FIG. 25 is a view for explaining an embedding step in the first modification. As illustrated in FIG. 25, after removing the formwork 310, an embedding step of embedding a truncated cone-shaped mortar cone (embedding body) 318 to the hole 317 is performed. In the case where the lower portion 315*c* of the curing sheet 315 is here left, the mortar cone 318 is embedded in the state where the lower portion 315*c* is folded inside the hole 317. The mortar cone 318 is secured by a nail portion buried inside grasping the external thread of the separator bar portion 316. This allows the upper portion 315*b* and the lower portion 315*c* of the curing sheet 315 to be tucked by the mortar cone 318 and concrete C, enabling to achieve holding of the curing sheet 315 to the concrete C.

The embedding body for filling the hole 317 is not limited to a mortar body, and other proper material can be used. The shape of the embedding body is not limited to a truncated cone-shape (cone shape) and may be any shape corresponding to the hole 17.

Subsequently, a curing step of curing the concrete structure using the curing sheet 315 left on the surface of the concrete C is performed. In this curing, the formwork 310 is already removed, and the curing can be continued for a long period as it is without use of any special facilities by only leaving the curing sheet 315 on the concrete surface.

Thereafter, a detaching step of peeling the curing sheet 315 from the surface of the concrete C is performed, after a predetermined curing period is terminated. The upper portion 315*b* and the lower portion 315*c* sandwiched between the mortar cone 318 and concrete C are here cut off, and left on the concrete C. If necessary, a process of removing the cutoff of the curing sheet 315, left on the concrete C, is performed. Thus, a concrete structure is completed.

According to the method for manufacturing a concrete structure of the first modification described above, the upper portion 315*b* and the lower portion 315*c* of the curing sheet 315 can be tucked between the mortar cone 318 and the concrete C to properly hold the curing sheet 315 on the concrete C. Moreover, this method is advantageous in terms of cost because it is not necessary to provide a new member for holding the curing sheet 315 or use an adhesive material.

Furthermore, in this manufacturing method, since the concrete C is placed in the placement step in the state where the upper portion 315*b* of the curing sheet 315 is folded inside along the cone 314, the upper portion 315*b* can be attached to the concrete C by hardening of the concrete C, to thereby inhibit the curing sheet 315 from being peeled off. Thus, the curing sheet 315 is avoided from being peeled from the concrete C in removal of the cone 314 in demolding, and thus the curing sheet 315 can be left as it is and properly held by the mortar cone 318. In this case, since it is possible to progress to the curing step without peeling the curing sheet 315 from the concrete C in demolding, generation of bleeding water can be suppressed to perform effective curing, manufacturing a concrete structure having sufficient strength, durability, watertightness and the like.

[Second Modification]

Figure 26:
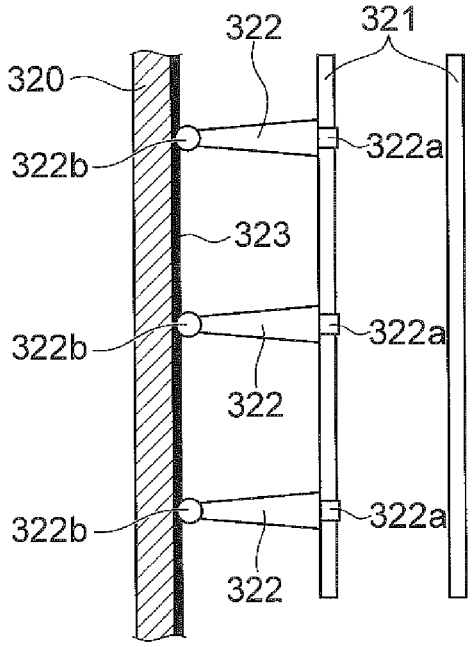
FIG. 26 is a view for explaining a mold installation step of a second modification for leaving the curing sheet on the concrete.

With respect to a method for manufacturing a concrete structure according to a second modification, holding of a curing sheet by utilizing a spacer will be described. FIG. 26 is a view for explaining a mold installation step in the second modification.

In the method for manufacturing a concrete structure according to the second modification, first, as illustrated in FIG. 26, a mold installation step of installing a formwork 320, a reinforcing bar 321, a spacer 322, a curing sheet 323 and the like at predetermined positions is performed. The spacer 322 is a member for constantly maintaining a gap between the reinforcing bar 321 and the formwork 320. The spacer 322 has a securing portion 322*a* coupled to the reinforcing bar 321, and a connection portion 322*b* connected to the curing sheet 323 disposed on the inner surface of the formwork 320.

The method of connecting the spacer 322 to the curing sheet 323 is not particularly limited. For example, the connection portion 322*b* of the spacer 322 may be connected to the curing sheet 323 by an adhesive, or a pressure-sensitive adhesive not to be solidified. A retarded curing type adhesive can also be used in consideration of the time difference of the installation operation and the like. Furthermore, the connection portion 322*b* of the spacer 322 and the curing sheet 323 may also be connected by a magnetic force. Magnets mutually attracted may also be disposed, or a powder that generates a magnetic force may also be kneaded into the curing sheet 323. A magnet may also be disposed on the formwork 320 to thereby tuck and hold the curing sheet 323 between the spacer 322 and the magnet.

Figure 27:
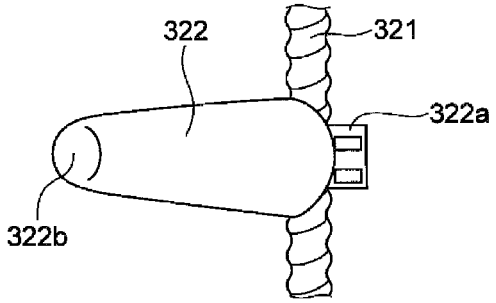
FIG. 27(*a*) is a perspective view illustrating a cone-shaped spacer.
Figure 27:
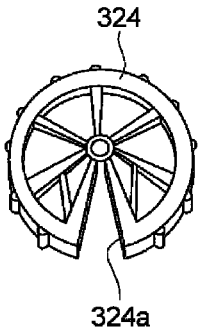
Figure 27:
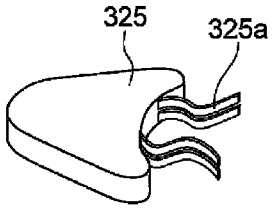

Three kinds of spacers are here exemplified with reference to FIG. 27. FIG. 27(*a*) is a perspective view illustrating a cone-shaped spacer. A spacer 322 illustrated in FIG. 27(*a*) is a concrete member having a cone shape. The spacer 322 is provided with a connection portion 322*b* on the tip thereof and a securing portion 322*a* opposite to the tip.

FIG. 27(*b*) is a perspective view illustrating a wheel-shaped spacer. A spacer 324 illustrated in FIG. 27(*b*) is a resin member having a wheel shape, and a notch portion 324*a* toward the center is formed on a part of the wheel shape. The spacer 324 is secured by tucking the reinforcing bar 321 into the notch portion 324*a*, and any end portion on the circumference is connected to the curing sheet 323.

FIG. 27(*c*) is a perspective view illustrating a substantially triangular plate-shaped block spacer. A spacer 325 illustrated in FIG. 27(*c*) is a substantially triangular plate-shaped block concrete member. The spacer 325 is connected to a curing sheet 323 with one end of the triangle serving as a tip, and a metallic securing portion 325*a* that tucks the reinforcing bar 321 is provided opposite to the tip. Hereinabove, though the spacer is described, the spacer illustrated in FIG. 27 is one example, and the spacer that can be utilized in the present invention is not particularly limited to the above spacers.

Figure 28:
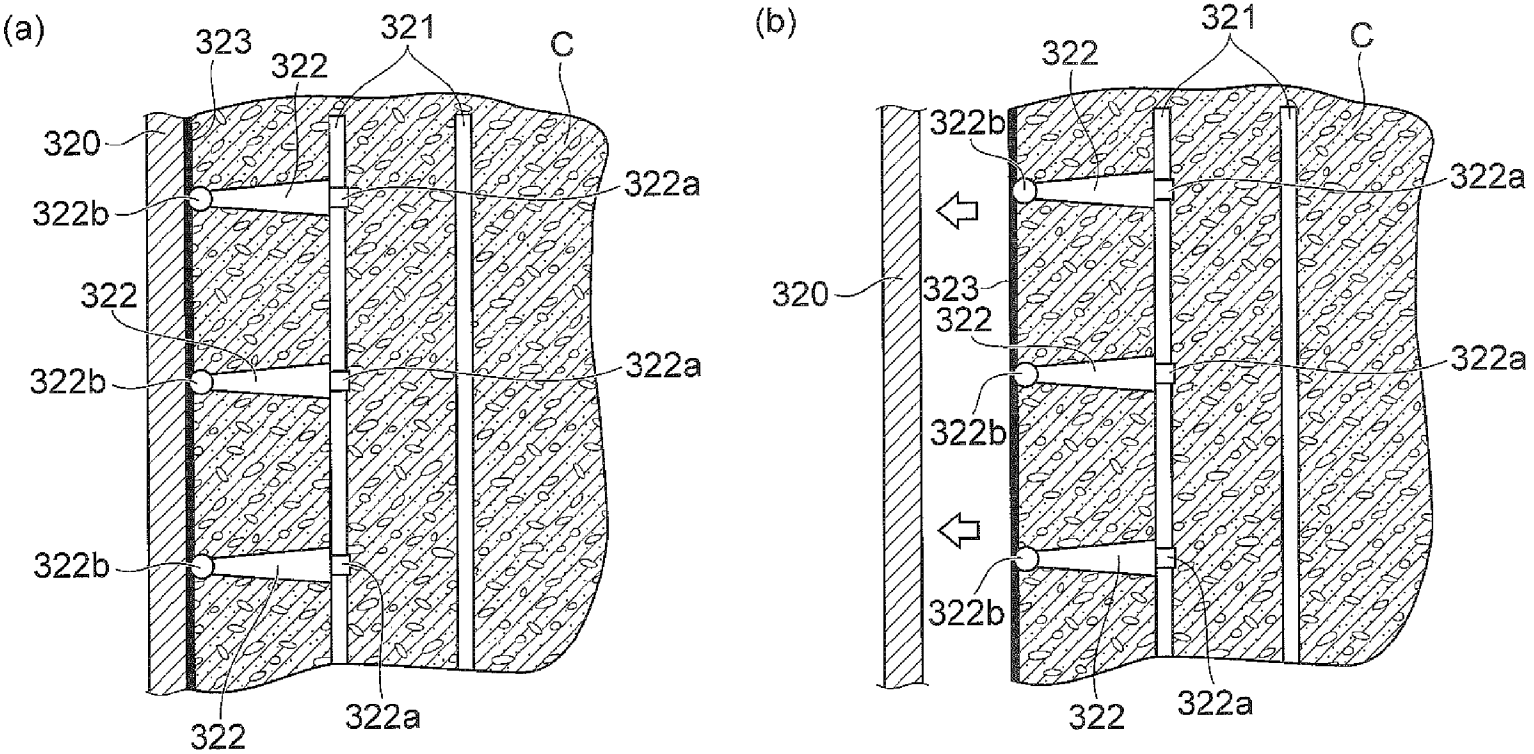
FIG. 28(*a*) is a view for explaining a placement step of the second modification.

FIG. 28(*a*) is a view for explaining a placement step in the second modification. After the mold installation step, as illustrated in FIG. 28(*a*), a placement step of pouring concrete C into the formwork 320 is performed. In the placement step, the spacer 322 is embedded into the concrete C while being connected to the curing sheet 323.

FIG. 28(*b*) is a view for explaining a demolding step in the second modification. Once concrete placement and fastening are terminated and the period of wet curing is lapsed, a demolding step of removing the formwork 320 is performed as illustrated in FIG. 28(*b*). The curing sheet 323 is not peeled off even by removal of the formwork 320, because of being connected to the spacer 322.

Thereafter, a detaching step of peeling the curing sheet 323 from the surface of the concrete C is performed, after a predetermined curing period is terminated. The curing sheet 323 is here pulled and peeled from the spacer 322. Thus, a concrete structure is completed.

According to the method for manufacturing a concrete structure according to the second modification described hereinabove, since the connection portion 322*b* of the spacer 322 is connected to the curing sheet 323, the curing sheet 323 can be properly held without being peeled off even in demolding. Thus, the curing sheet 323 is avoided from being peeled in demolding to cause drying of the concrete surface, enabling to improve the durability and the outer appearance of the concrete structure. Furthermore, a magnet is embedded to the connection portion 322*b* at the tip of the spacer 322 to prepare the spacer in advance and this magnet is buried in the concrete structure, thereby also allowing the curing sheet 323 to be secured from the concrete surface by a magnetic body such as a magnet or iron after demolding.

[Third Modification]

Figure 29:
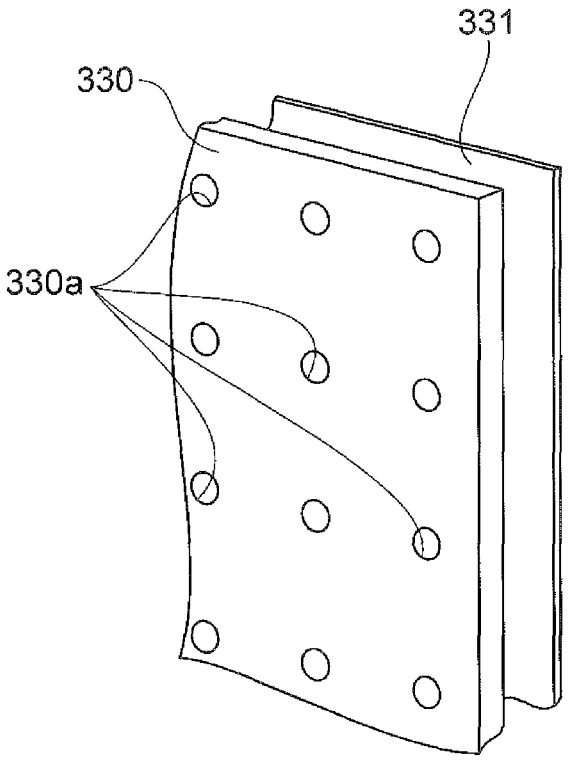
FIG. 29 is a perspective view illustrating a formwork and a curing sheet of a third modification for leaving the curing sheet on the concrete.

With respect to a method for manufacturing a concrete structure according to a third modification, holding of a curing sheet utilizing a holding pin will be described. FIG. 29 is a perspective view for explaining a formwork 330 and a curing sheet 331 in the third modification. As illustrated in FIG. 29, pinholes 330*a* for insertion of a holding pin 332 described later are formed in the formwork 330 at a predetermined interval. The curing sheet 331 is disposed on the inner surface of the formwork 330. The curing sheet 331 is attached to the inner surface of the formwork 330 by, for example, grease, water, an adhesive or a pressure-sensitive adhesive.

Figure 30:
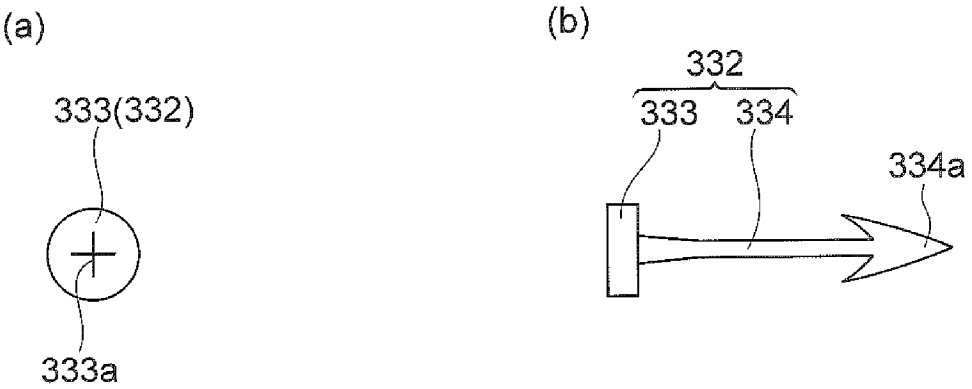
FIG. 30(*a*) is a rear view illustrating a holding pin.

FIG. 30(*a*) is a rear view illustrating the holding pin 332. FIG. 30(*b*) is a side view illustrating the holding pin 332. As illustrated in FIGS. 30(*a*) and 30(*b*), the holding pin 332 is a resin member having a disk-shaped sheet stopper 333 and a pin main body 334 projecting from the center of the sheet stopper 333. The holding pin 332 can be made of a polymer compound such as an epoxy resin. A cross groove 333*a* for insertion of a cross slot screw driver is formed on the rear surface of the sheet stopper 333. A barb 334*a* is provided on the tip of the pin main body 334.

Figure 31:
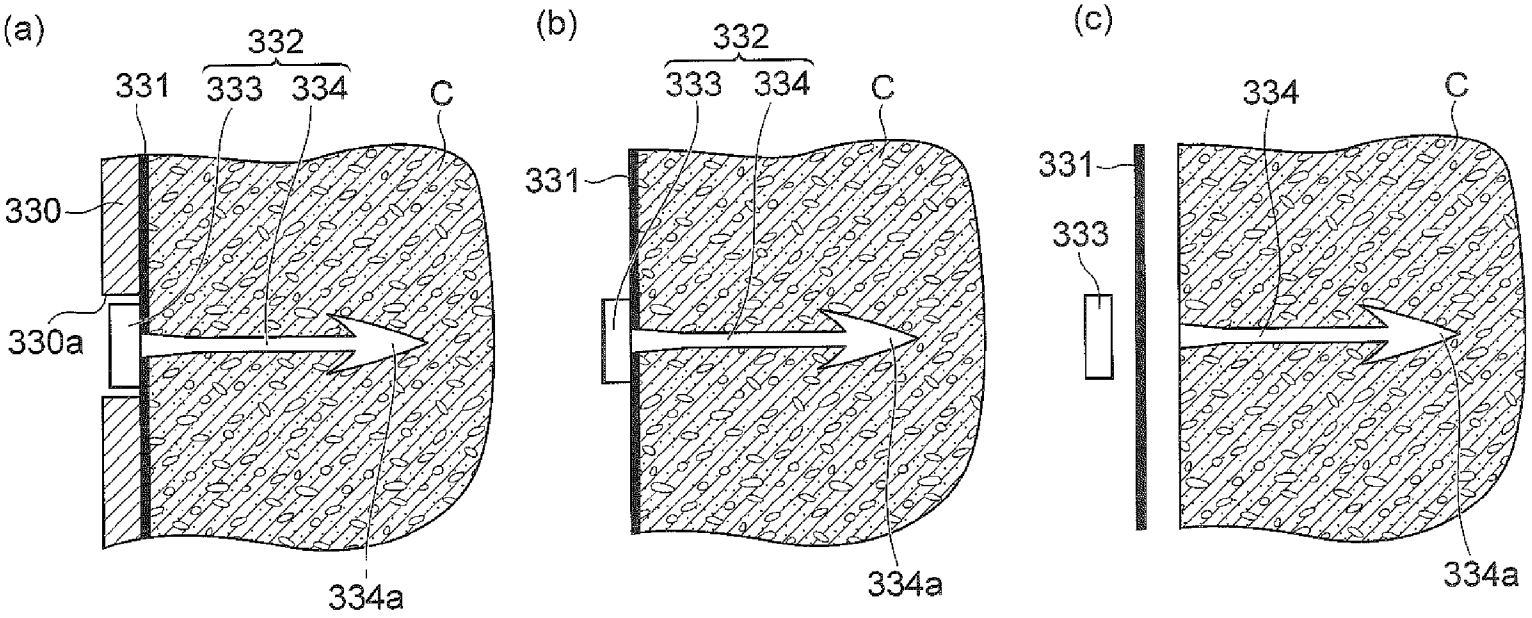
FIG. 31(*a*) is a view for explaining a placement step of the third modification.

FIG. 31(*a*) is a view for explaining a placement step in the third modification. As illustrated in FIG. 31(*a*), in the method for manufacturing a concrete structure according to the third modification, a placement step of placing concrete in the state where the sheet stopper 333 is disposed outside the curing sheet 331 (facing the formwork 330) and the pin main body 334 is disposed inside the curing sheet 331 (facing concrete C placed), is performed. The holding pin 332 is mounted to the curing sheet 331 by insertion through the pinhole 330*a* of the formwork 330 with the curing sheet 331 disposed on the inner surface thereof, and by penetration of the pin main body 334 through the curing sheet 331. Concrete C is hardened to thereby secure the pin main body 334 of the holding pin 332 to the concrete C.

The size of the holding pin 332 can be, for example, about 10 mm in length, and the diameter of the pin main body 334 can be about 1 mm. The size of the sheet stopper 333 can be about 2 to 5 mm in diameter.

FIG. 31(*b*) is a view for explaining a demolding step in the third modification. Once concrete placement and fastening are terminated and the period of wet curing is lapsed, a demolding step of removing the formwork 330 is performed as illustrated in FIG. 31(*b*). The curing sheet 331 is not peeled off even by removal of the formwork 330, because of being held on the concrete C by the holding pin 332.

FIG. 31(*c*) is a view for explaining a detaching step in the third modification. Once a predetermined curing period is terminated, a detaching step of peeling the curing sheet 331 from the surface of the concrete C is performed as illustrated in FIG. 31(*c*). In the detaching step, the sheet stopper 333 of the holding pin 332 is cut off from the pin main body 334. For example, it is cut off from the pin main body 334 by insertion of a screw driver to the cross groove 333*a* formed on the rear surface of the sheet stopper 333 for threading. Thus, the curing sheet 331 is peeled from the surface of the concrete C to complete a concrete structure.

According to the method for manufacturing a concrete structure according to the third modification described hereinabove, since placement of the concrete C is performed in the state where the holding pin 332 projects to the inside the curing sheet 331, the concrete C is hardened to thereby secure the pin main body 334 of the holding pin 332 to the concrete C, thereby enabling to properly hold the curing sheet 331 sandwiched between the concrete C and the sheet stopper 333.

[Fourth Modification]

Figure 32:
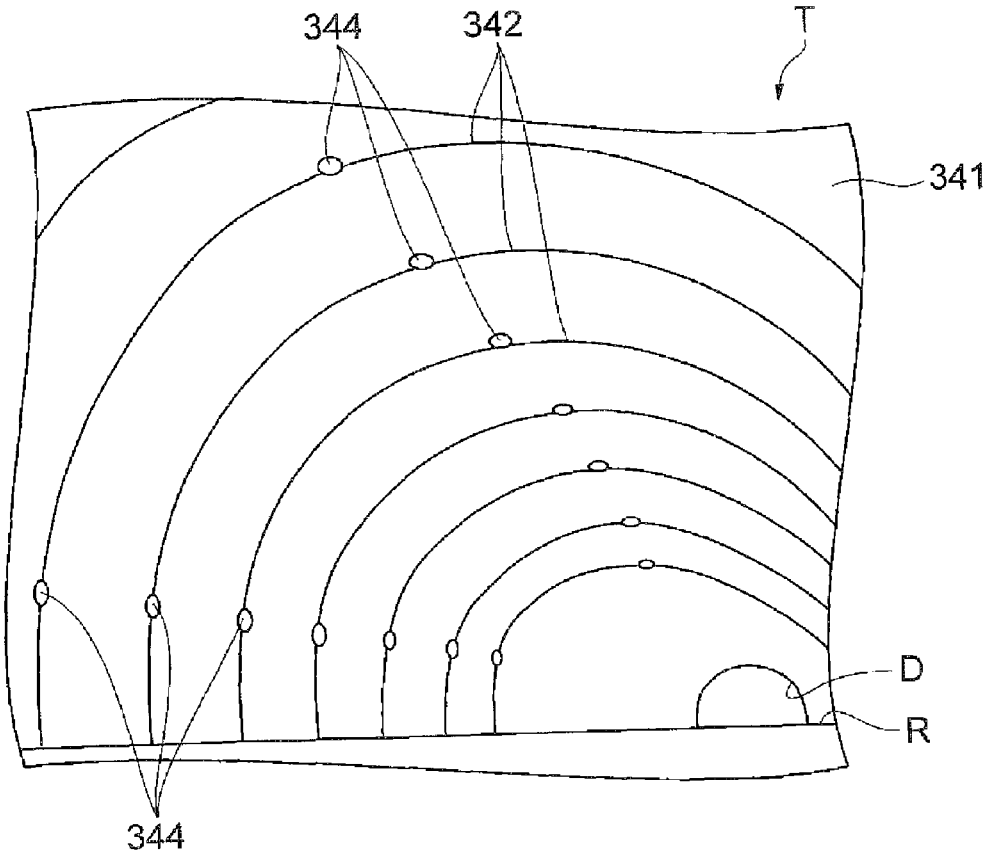
FIG. 32 is a view for explaining a holding state of a curing sheet according to a fourth modification for leaving the curing sheet on the concrete.
Figure 33:
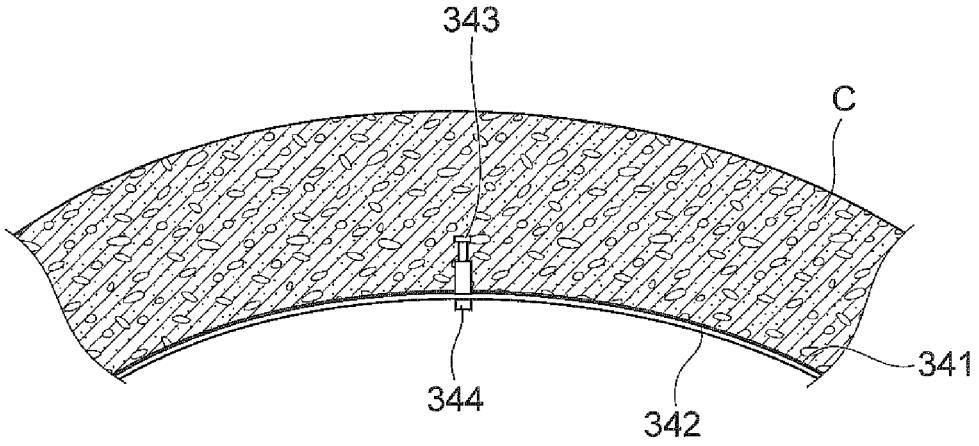
FIG. 33 is a cross-sectional view illustrating the holding state of the curing sheet according to the fourth modification.

In a method for manufacturing a concrete structure according to a fourth modification, holding of a curing sheet by utilizing an anchor and a long holding plate will be described. FIG. 32 is a view for explaining a holding state of the curing sheet according to the fourth modification. FIG. 33 is a cross-sectional view for explaining the holding state of the curing sheet according to the fourth modification.

As illustrated in FIG. 32 and FIG. 33, the concrete structure according to the fourth modification is a tunnel T, and a curing sheet 341 is disposed on the inner surface. The curing sheet 341 is held from the inside by a long holding plate 342. FIG. 32 illustrates inlet and outlet D and a road surface R of the tunnel T.

The long holding plate 342 is a resin plate member having a length that allows the inner surface of the tunnel T to be covered in the width direction, and has a strength sufficient for supporting the curing sheet 341. For the holding plate 342, for example, a functional polyolefin resin having excellent shape holding property, strength and rigidity can be adopted. The thickness of the holding plate 342 is, for example, 2 mm.

As illustrated in FIG. 33, the long holding plate 342 is secured to an anchor 343 embedded in concrete C forming the tunnel T, by a bolt 344. The long holding plate 342 is disposed along the outside (downside) of the curing sheet 341, and secured to the concrete C by a plurality of anchors 343 and bolts 344.

Figure 34:
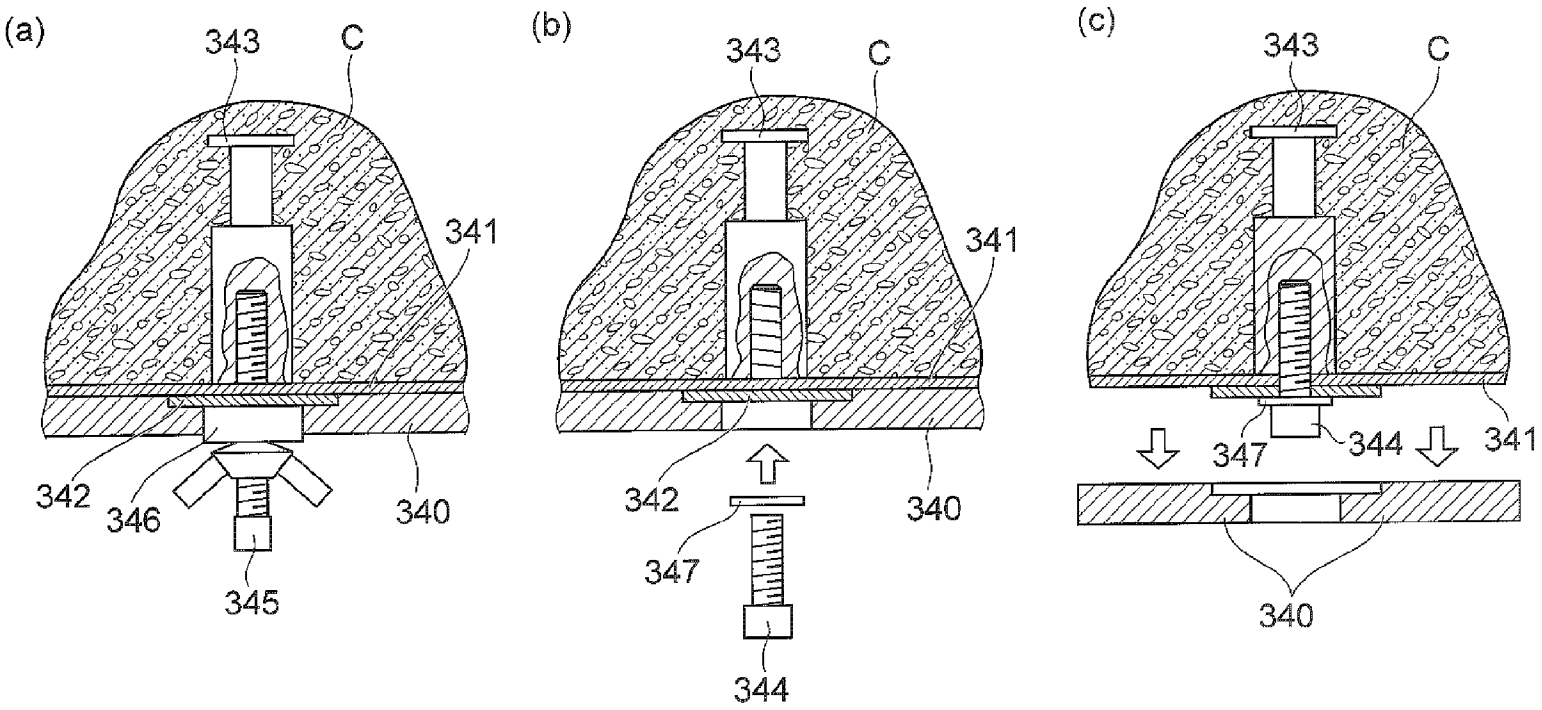
FIG. 34(*a*) is a view for explaining a placement step of the fourth modification.

Here, FIG. 34(*a*) is a view for explaining a placement step in the fourth modification. In the method for manufacturing a concrete structure according to the fourth modification, the curing sheet 341 is disposed on the upper surface (inner surface) of a faceplate (formwork) 340 as a center in advance.

A mounting bolt 345 is screwed from the downside of the faceplate 340 into an internal thread in the anchor 343 with a rubber 346 interposed therebetween in the state where the anchor 343 is disposed on the upside of the curing sheet 341 and the holding plate 342 is disposed on the downside of the curing sheet 341. A hole through which the mounting bolt 345 is inserted is formed on each of the faceplate 340, the curing sheet 341 and the holding plate 342 in advance. Placement of concrete C is performed in this state as illustrated in FIG. 34(*a*). When the concrete C is hardened, the anchor 343 is secured into the concrete C.

FIG. 34(*b*) is a view for explaining a bolting step in the fourth modification. After the termination of concrete placement and fastening, and the lapse of the period of wet curing, a bolting step of removing the mounting bolt 345 mounted to the anchor 343 and mounting a bolt 344 having a smaller diameter than the hole of the faceplate 340 to the anchor 343 is performed in the fourth modification as illustrated in FIG. 34(*b*). The bolt 344 is, for example, a hexagonal bolt, and secures the curing sheet 341 and the holding plate 342 to the anchor 343 via a washer 347.

FIG. 34(*c*) is a view for explaining a demolding step in the fourth modification. After the bolting step, a demolding step of removing the faceplate 340 is performed. The curing sheet 341 is not peeled off even by removal of the faceplate 340, because of being held by the holding plate 342 sandwiched between the anchor 343 and the bolt 344.

Thereafter, once a predetermined curing period is terminated, a detaching step of removing the bolt 344 from the anchor 343 to remove the holding plate 342, thereby peeling the curing sheet 341 from the surface of the concrete C of the tunnel T is performed. Thus, a tunnel T as a concrete structure is completed.

According to the method for manufacturing a concrete structure according to the fourth modification described hereinabove, since the holding plate 342 disposed along the outside of the curing sheet 341 is bolted to the anchor 343, the concrete C placed is hardened to thereby secure the anchor 343 to concrete C, thereby enabling to properly hold the curing sheet 341 by the holding plate 342.

[Fifth Modification]

Figure 35:
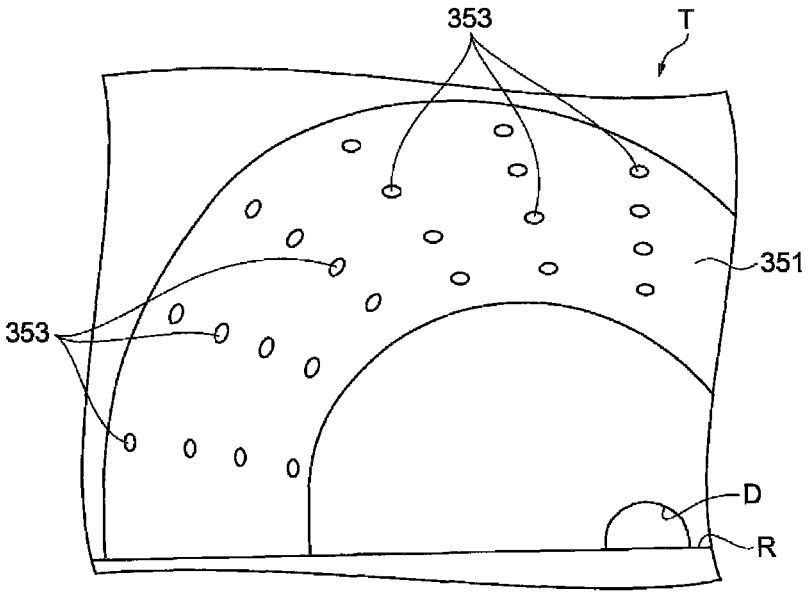
FIG. 35 is a view for explaining a holding state of a curing sheet according to a fifth modification for leaving the curing sheet on the concrete.
Figure 36:
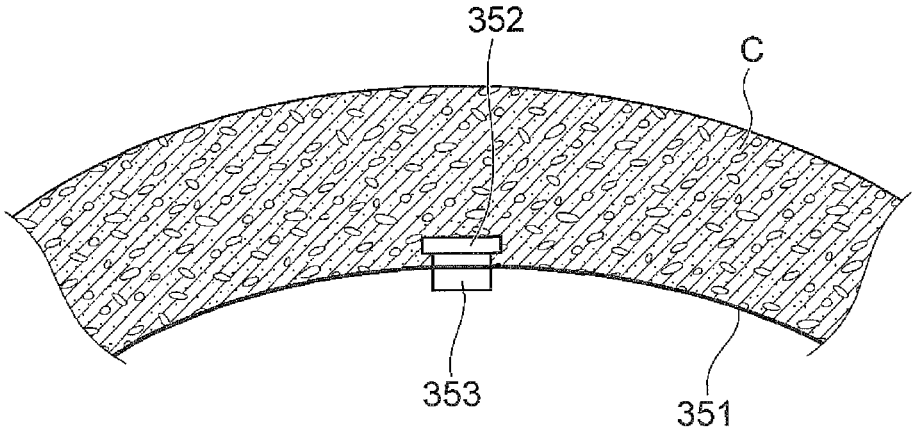
FIG. 36 is a cross-sectional view for explaining the holding state of the curing sheet of the fifth modification.

In a method for manufacturing a concrete structure according to a fifth modification, holding of a curing sheet by utilizing a magnet embedded in concrete will be described. FIG. 35 is a view for explaining a holding state of the curing sheet according to the fifth modification. FIG. 36 is a cross-sectional view for explaining a holding state of the curing sheet according to the fifth modification.

As illustrated in FIG. 35 and FIG. 36, the concrete structure according to the fifth modification is a tunnel T, and a curing sheet 351 is disposed on the inner surface. The curing sheet 351 is held from the inside by a first magnet 352 embedded in concrete C and a second magnet 353 disposed outside the curing sheet 315.

Figure 37:
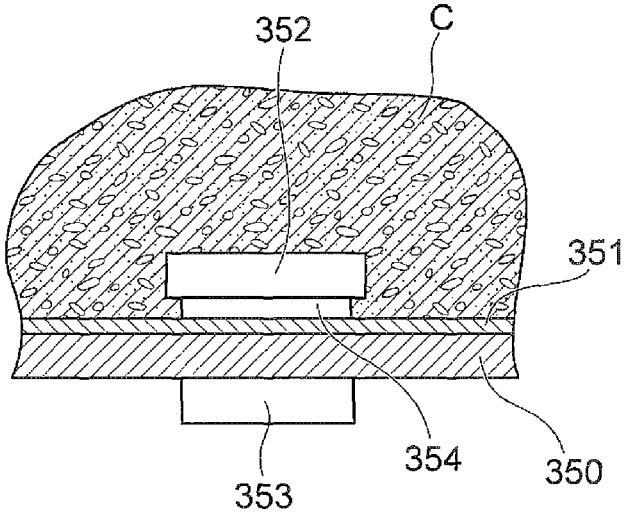
FIG. 37 is a view for explaining a placement step of the fifth modification.

FIG. 37 is a view for explaining a placement step in the fifth modification. In the method for manufacturing a concrete structure according to the fifth modification, the curing sheet 351 is disposed on the upper surface (inner surface) of a faceplate (formwork) 350 as a center in advance, and the first magnet 352 corresponding to the upside and the second magnet 353 corresponding to the downside are disposed so as to tuck the curing sheet 351 and the faceplate 350. The placement step of placing the concrete C is performed in this state as illustrated in FIG. 37.

After the termination of concrete placement and fastening, and the lapse of the period of wet curing, a demolding step of removing the second magnet 353 corresponding to the downside to remove the faceplate 350 is performed. After the faceplate 350 is removed, the curing sheet 351 is again held on the concrete C by the second magnet 353. A through-hole through which the second magnet 353 can pass may be provided on the faceplate 350 to enable formwork removing without removal of the second magnet 353.

Thereafter, once a predetermined curing period is terminated, a detaching step of removing the second magnet 353 to thereby peel the curing sheet 351 from the surface of the concrete C is performed. Thus, a tunnel T as a concrete structure is completed.

As long as one of the first magnet 352 and the second magnet 353 is a magnet, the other may be a ferromagnetic body such as iron. It is preferable that a magnet disposed in the concrete C be rustproof.

According to the method for manufacturing a concrete structure according to the fifth modification described hereinabove, since the concrete C placed is hardened to thereby secure the first magnet 352 in the concrete C, the second magnet 353 is disposed on the outside of the curing sheet 351 to enable to properly hold the curing sheet 351.

The method for manufacturing a concrete structure according to the fifth modification may have a configuration in which an iron powder as a ferromagnetic body is mixed in the curing sheet 351 to allow the curing sheet 351 itself and the first magnet 352 to attract to each other by a magnetic force. In this case, the curing sheet 351 is attracted to the first magnet 352 in the concrete C by a magnetic force, enabling to properly hold the curing sheet 351. The second magnet 353 or a ferromagnetic body is not necessarily disposed on the outside of the curing sheet 351 in this case.

[Sixth Modification]

Figure 38:
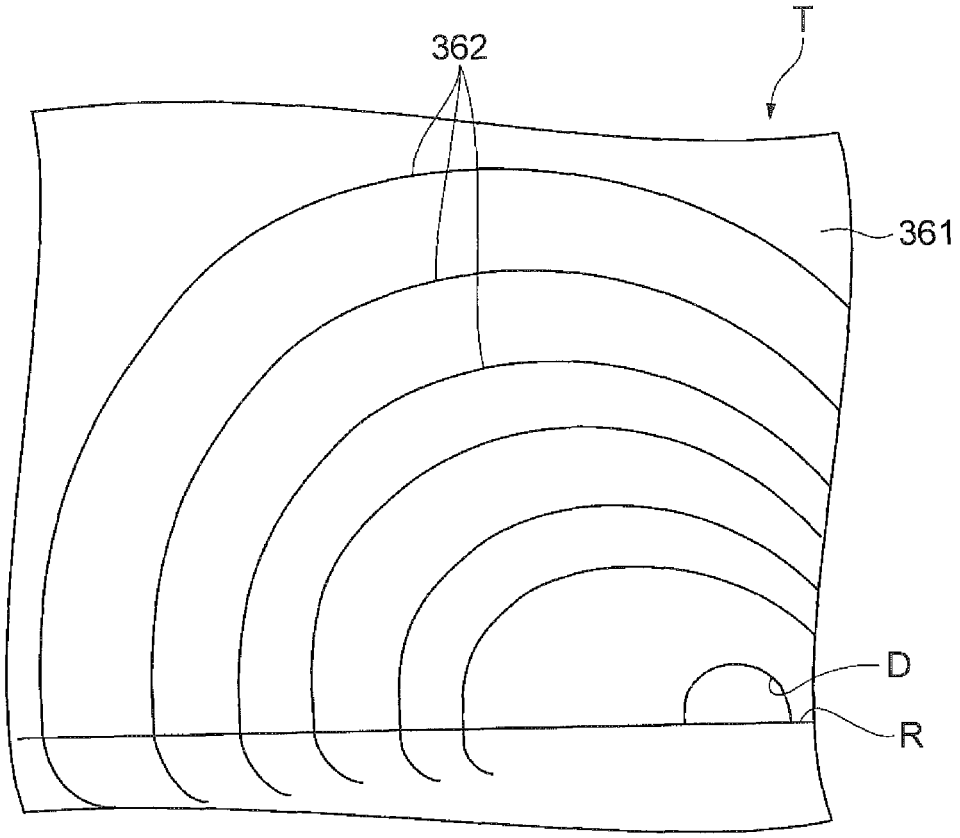
FIG. 38 is a view for explaining a holding state of a curing sheet according to a sixth modification for leaving the curing sheet on the concrete.
Figure 39:
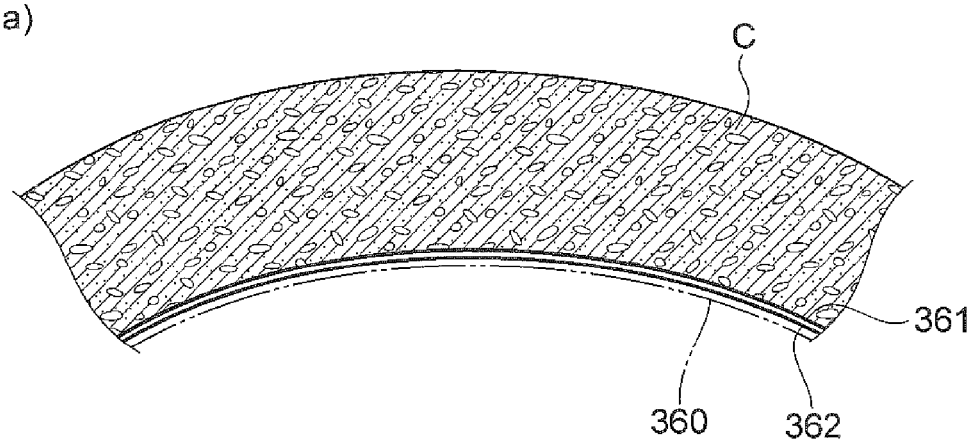
FIG. 39(*a*) is a cross-sectional view for explaining the holding state of the curing sheet according to the sixth modification.
Figure 39:
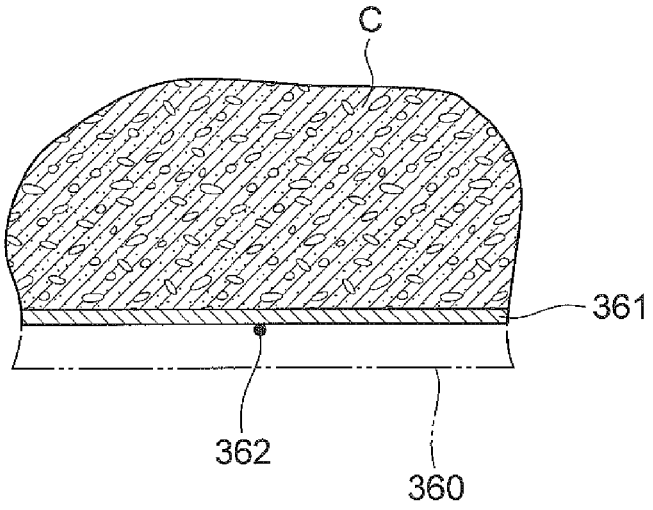

In a method for manufacturing a concrete structure according to a sixth modification, holding and detaching of a curing sheet by utilizing a piano wire (rigid wire rod) will be described. FIG. 38 is a view for explaining a holding state of the curing sheet according to the sixth modification. FIG. 39(*a*) is a cross-sectional view for explaining the holding state of the curing sheet according to the sixth modification. FIG. 39(*b*) is a cross-sectional view for explaining the state where the piano wire and the curing sheet are secured. FIG. 39(*a*) and FIG. 39(*b*) illustrate cross-sectional views as viewed from directions different from each other by 90° in the horizontal direction.

As illustrated in FIG. 38, FIG. 39(*a*) and FIG. 39(*b*), the concrete structure according to the sixth modification is a tunnel T, and a curing sheet 361 is disposed on the inner surface. The curing sheet 361 is integrated with a piano wire 362. In the present embodiment, the piano wire 362 is disposed on the downside (outside) of the curing sheet 361. The diameter of the piano wire 362 is, for example, 0.08 mm.

The piano wire 362 may be embedded in or may be sutured to the curing sheet 361. The piano wire 362 may be adhered to the curing sheet 361. The curing sheet 361 and the piano wire 362 integrated in advance may be provided, or the curing sheet 361 and the piano wire 362 may be integrated by adhesion on-site.

The curing sheet 361 is disposed so that the piano wire 362 extends along the width direction of the tunnel T. This piano wire 362 has sufficient elasticity, and is bent along the inner surface of the tunnel T to allow the curing sheet 361 to be stuck to the inner surface of the tunnel T by its returning elasticity. Thus, the curing sheet 361 can be held on the concrete C. In removal of a center, a mechanism can be provided in which the piano wire 362 is pulled to lining to thereby allow the curing sheet 361 not to be peeled.

Furthermore, this piano wire 362 has an extra length portion protruding from the curing sheet 361 and the extra length portion extends to the road surface R of the tunnel T, as illustrated in FIG. 38.

The rigid wire rod to be integrated with the curing sheet 361 is not necessarily the piano wire 362, and may be any material having sufficient rigidity. From the viewpoint of holding the curing sheet 361, it is preferable to have adequate elasticity. For such a rigid wire rod, for example, a functional polyolefin resin having excellent shape holding property, strength and rigidity can be adopted. The extra length portion does not necessarily have a length extending to the road surface R, and may have a length easy to handle.

According to the method for manufacturing a concrete structure of the sixth modification described hereinabove, since the piano wire 362 is integrated with the curing sheet 361 and the piano wire 362 has an extra length portion, the extra length portion of the piano wire 362 is pulled to thereby enable to easily peel the curing sheet 361, making the detaching operation efficient, in the detaching step of peeling the curing sheet 361 from the concrete C.

EXAMPLES

Hereinafter, the present invention will be described in detail with reference to Examples, but the present invention is not limited to these Examples.

First, concrete of materials and formulation shown in Table 1 and Table 2 below was produced.

TABLE 1

| Materials | | Symbols | Notes |
|---|---|---|---|
| Water | | W | Tap water of Chofu City |
| Cement | | C | Ordinary Portland Cement manufactured by Taiheiyo Cement Corporation density: 3.16 g/cm$^3$, blaine value: 3320 cm$^2$/g |
| Fine aggregate | Fine aggregate A | SA | Crashed sand (tight sand), manufactured by Ryokolime Industry Co., Ltd., produced in Miyama Cho, Hachioji City density: 2.65 g/cm$^3$, F.M.: 2.98, water absorption rate: 0.96 |

TABLE 1-continued

| Materials | | Symbols | Notes |
|---|---|---|---|
| | Fine aggregate B | SB | Mountain sand, manufactured by Chiba Sekisan K. K., produced in Yoshino, Kimitsu City density: 2.61 g/cm$^3$, F.M.: 1.61, water absorption rate: 2.11 SA:SB = 85:15 |
| Coarse aggregate | Coarse aggregate | G | Crushed stone (tight sand), manufactured by Okutama Kogyo Co., Ltd., produced in Ome City density: 2.65 g/cm$^3$, F.M.: 6.71, water absorption rate: 0.58, solid volume percentage: 62.6% |
| AE water reducing agent | | AD | Flowric S |

TABLE 2

| Ratio of water to cement (%) [W/C] | Amount of air (%) [Air] | Ratio of fine aggregate (%) [s/a] | Amount per unit (kg/m$^3$) Water [W] | Cement [C] | Fine aggregate [SA] | Fine aggregate [SB] | Coarse aggregate [G] | AE water reducing agent (kg/m$^3$) [AD] |
|---|---|---|---|---|---|---|---|---|
| 50 | 5.0 | 42 | 175 | 350 | 626 | 110 | 1021 | 5.25 |

Figure 40:
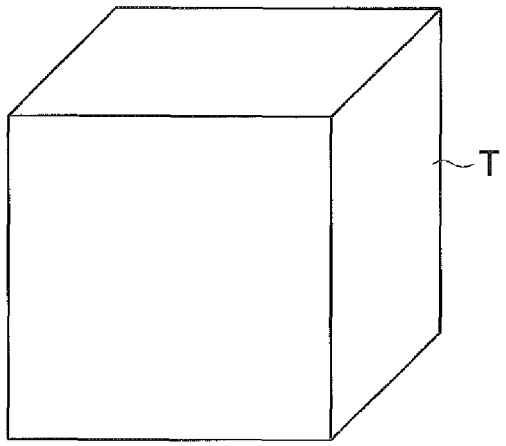
FIG. 40 is a perspective view illustrating a general test piece for use in Examples.

Subsequently, the concrete of materials and formulation shown in Tables 1 and 2 was used to produce a test piece T illustrated in FIG. 40. The test piece T was a block measuring 900 mm on a side. When this test piece T was produced, each of curing sheets (Examples 1 to 9) having a contact angle θ of the contact surface with the concrete of 52 degrees to 115 degrees was attached to the inner surface of the formwork, followed by performing placing of each concrete. The concrete was poured in one layer, and after the formwork was removed at a material age of 5 days, physical properties shown in Table 3 below were measured at a material age of 91 days.

TABLE 3

| Items tested | Standards |
|---|---|
| Concrete slump | JIS A 1101 |
| Amount of air | JIS A 1128 |
| Carbonation depth | Promotion carbonation test |
| Surface air bubble area ratio | Tracing paper method |
| Rebound hardness (Schmidt hammer) | Rebound hardness method |
| Air permeability | Torrent method |
| Surface water absorption rate | — |
| Surface water content | Electromagnetic induction method |

An ordinary formwork (with no sheet attached) was used instead of the above curing sheet to produce a similar concrete test piece T in Comparative Example 1. A water permeable formwork (with no sheet attached) was used instead of the above curing sheet to produce a similar concrete test piece T in Comparative Example 2. Also in Comparative Examples 1 and 2, concrete was poured in one layer, and after the formwork was removed at a material age of 5 days, the physical properties shown in Table 3 above were measured at a material age of 91 days. In Comparative Example 2, a general curing sheet was attached to concrete immediately after demolding.

The curing sheets and the molds used in the test are shown in Table 4. The description of the formwork with respect to each of Examples 1 to 9 was omitted, but an ordinary formwork was used.

TABLE 4

| Cases | Components Types | Materials | Notes | Contact angle |
|---|---|---|---|---|
| Comparative Example 1 | Ordinary | Ordinary formwork | No sheet attached | — |
| Comparative Example 2 | Water permeable | Water permeable formwork | No sheet attached | — |
| Example 1 | Sheet 1 | Perfluoroalkoxy fluororesin | Neoflon PFA | 115 |
| Example 2 | Sheet 2 | Tetrafluoroethylene hexafluoropropylene copolymer | Neoflon FEP | 114 |
| Example 3 | Sheet 3 | Ethylene tetrafluoroethylene copolymer | Neoflon ETFE | 96 |
| Example 4 | Sheet 4 | Polypropylene | KK Sheet | 91 |
| Example 5 | Sheet 5 | Polyolefin | 3M Concrete curing tape | 90 |
| Example 6 | Sheet 6 | Polyvinylidene chloride | Saran Wrap (registered trademark) | 80 |
| Example 7 | Sheet 7 | Polyethylene terephthalate | PET | 69 |
| Example 8 | Sheet 8 | Polyvinyl chloride | Riken Wrap | 68 |
| Example 9 | Sheet 9 | Nylon 6 | Nylon sheet | 52 |

First, fresh properties of the concrete used in the present test were tested in placement, and it was found that the slump value was 14.5 cm and the amount of air was 4.6%.

With respect to concrete test pieces T (Examples 1 to 9) produced using respective sheets 1 to 9, and concrete test pieces T (Comparative Examples 1 and 2) produced using an ordinary formwork or a water permeable formwork, the carbonation depth, the surface air bubble area ratio, the rebound hardness, the air permeability, the surface water absorption rate and the surface water content were measured.

[Carbonation Depth]

Figure 41:
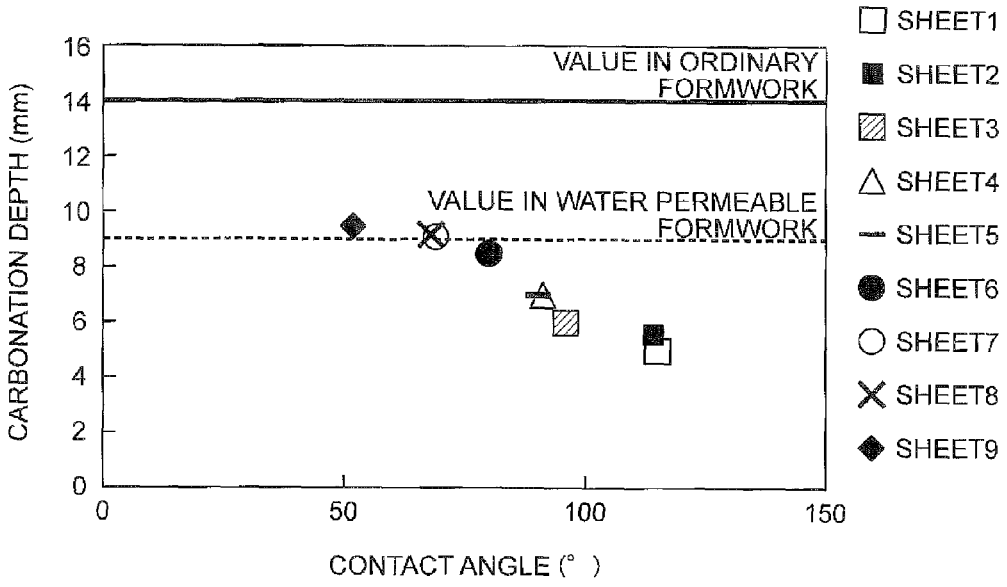
FIG. 41 is a graph showing the measurement results of the carbonation depth in Examples.

FIG. 41 shows a relationship between the carbonation depth and the contact angle θ of the sheet contact surface with respect to the test pieces T of Examples 1 to 9 and Comparative Examples 1 and 2. The carbonation depth could be smaller by attachment of the curing sheet in all the cases of Examples 1 to 9 than the case of the ordinary formwork in Comparative Example 1. When the contact angle was 52 to 69 degrees (Examples 7 to 9), the carbonation depth could be comparable with that of the water permeable formwork in Comparative Example 2 by attachment of the curing sheet. When the contact angle was 80 degrees or more (Example 6), the carbonation depth could be smaller than that in use of the water permeable formwork in Comparative Example 2. When the contact angle was 90 degrees or more (Examples 1 to 5), the carbonation depth could be much smaller than that in use of the water permeable formwork in Comparative Example 2.

[Surface Air Bubble Area Ratio]

Figure 42:
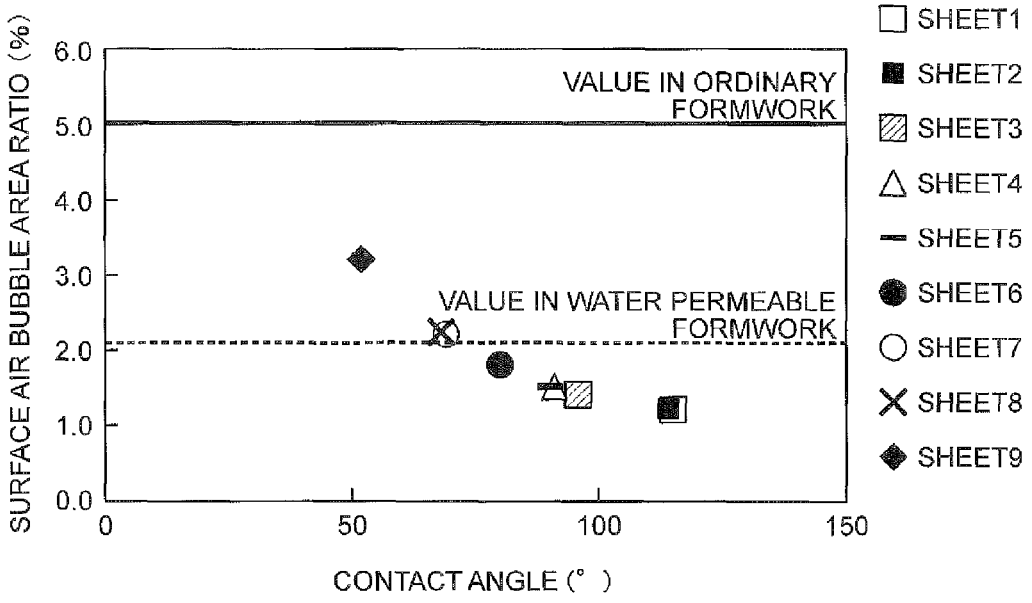
FIG. 42 is a graph showing the measurement results of the surface air bubble area ratio in Examples.

FIG. 42 shows a relationship between the surface air bubble area ratio and the contact angle θ of the sheet contact surface with respect to the test pieces T of Examples 1 to 9 and Comparative Examples 1 and 2. The surface air bubble area ratio could be smaller by attachment of the curing sheet in all the cases of Examples 1 to 9 than the case of the ordinary formwork in Comparative Example 1. When the contact angle was 80 degrees or more (Example 6), the surface air bubble area ratio could be smaller than that in use of the water permeable formwork in Comparative Example 2. When the contact angle was 90 degrees or more (Examples 1 to 5), the surface air bubble area ratio could be much smaller than that in use of the water permeable formwork in Comparative Example 2. As is clear from FIG. 42, it has been found that as the contact angle of the curing sheet is higher, the surface air bubble ratio is decreased.

[Rebound Hardness]

Figure 43:
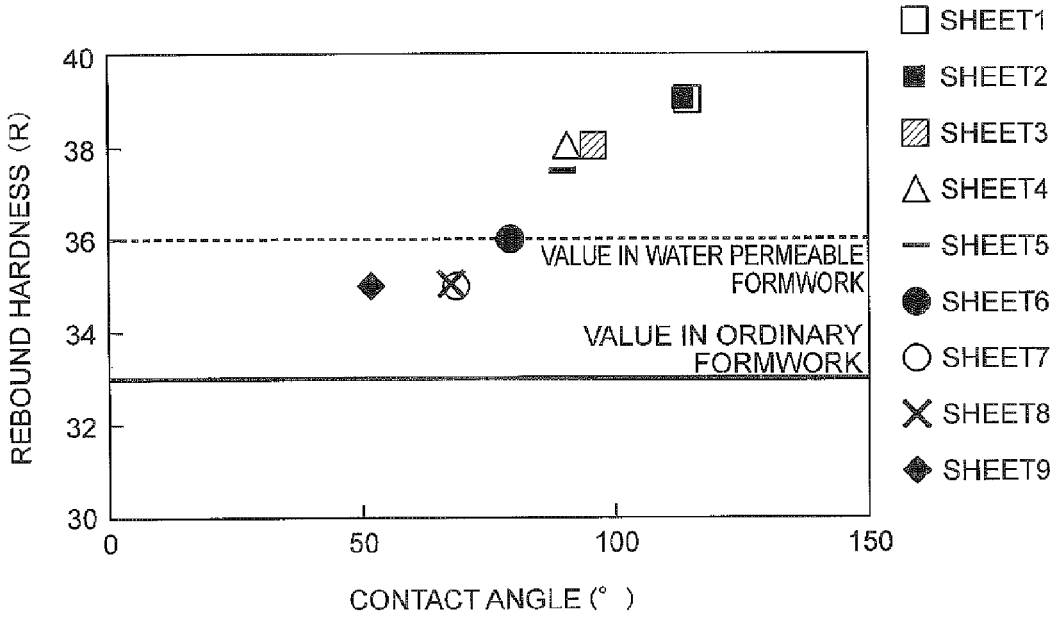
FIG. 43 is a graph showing the measurement results of the rebound hardness in Examples.

FIG. 43 shows a relationship between the rebound hardness and the contact angle θ of the sheet contact surface with respect to the test pieces T of Examples 1 to 9 and Comparative Examples 1 and 2. The rebound hardness could be higher by attachment of the curing sheet in all the cases of Examples 1 to 9 than the case of the ordinary formwork in Comparative Example 1. When the contact angle was 80 degrees (Example 6), the rebound hardness could be comparable with that of the water permeable formwork in Comparative Example 2. When the contact angle was 90 degrees or more (Examples 1 to 5), the rebound hardness could be much higher than that in use of the water permeable formwork in Comparative Example 2.

[Air Permeability]

Figure 44:
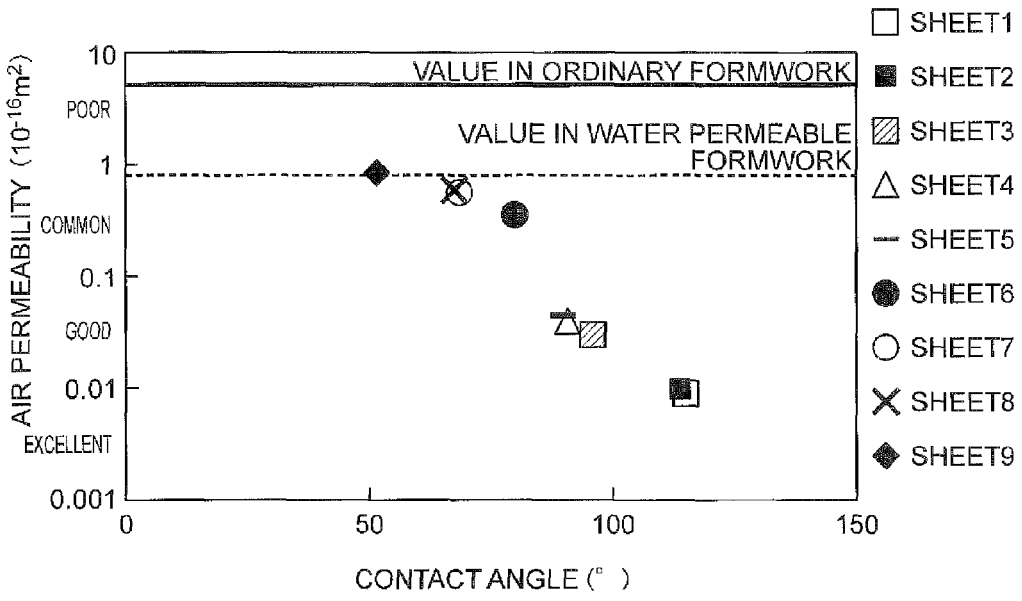
FIG. 44 is a graph showing the measurement results of the air permeability in Examples.

FIG. 44 shows a relationship between the air permeability and the contact angle θ of the sheet contact surface with respect to the test pieces T of Examples 1 to 9 and Comparative Examples 1 and 2. The air permeability could be smaller by attachment of the curing sheet in all the cases of Examples 1 to 9 than the case of the ordinary formwork in Comparative Example 1. When the contact angle was 52 degrees (Example 9), the air permeability could be comparable with that of the water permeable formwork in Comparative Example 2. When the contact angle was 68 degrees or more (Examples 6 to 8), the air permeability could be smaller than that in use of the water permeable formwork in Comparative Example 2. When the contact angle was 90 degrees or more (Examples 1 to 5), the air permeability could be much smaller than that in use of the water permeable formwork in Comparative Example 2.

[Surface Water Absorption Rate]

Figure 45:
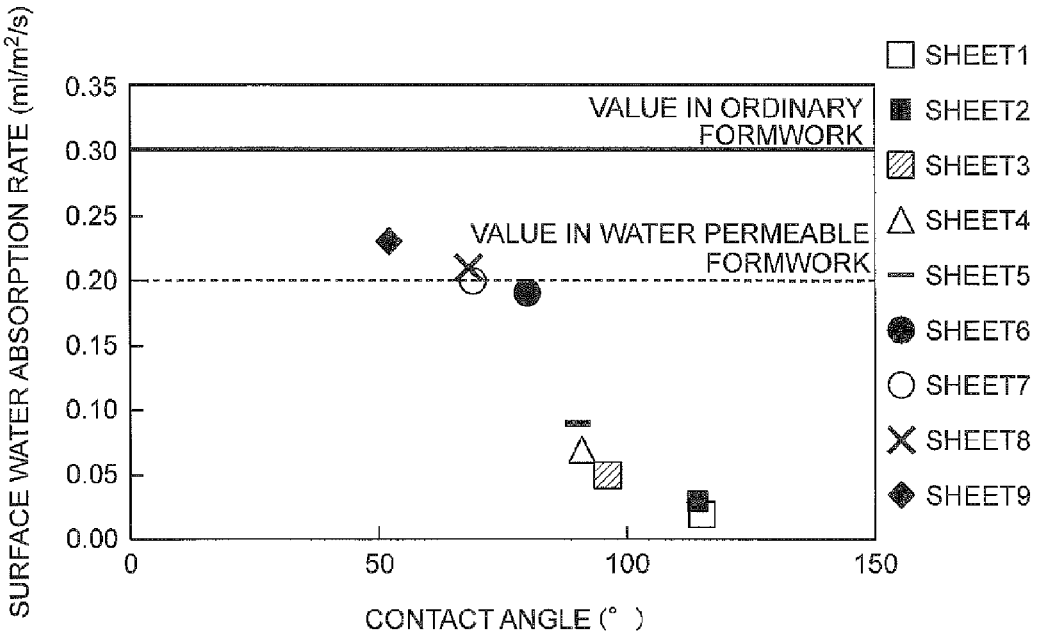
FIG. 45 is a graph showing the measurement results of the surface water absorption rate in Examples.

FIG. 45 shows a relationship between the surface water absorption rate and the contact angle θ of the sheet contact surface with respect to the test pieces T of Examples 1 to 9 and Comparative Examples 1 and 2. The surface water absorption rate could be smaller by attachment of the curing sheet in all the cases of Examples 1 to 9 than the case of the ordinary formwork in Comparative Example 1. When the contact angle was 68 degrees or more (Examples 6 to 8), the surface water absorption rate could be comparable with that of the water permeable formwork in Comparative Example 2. When the contact angle was 90 degrees or more (Examples 1 to 5), the surface water absorption rate could be much smaller than that in use of the water permeable formwork in Comparative Example 2.

[Surface Water Content]

Figure 46:
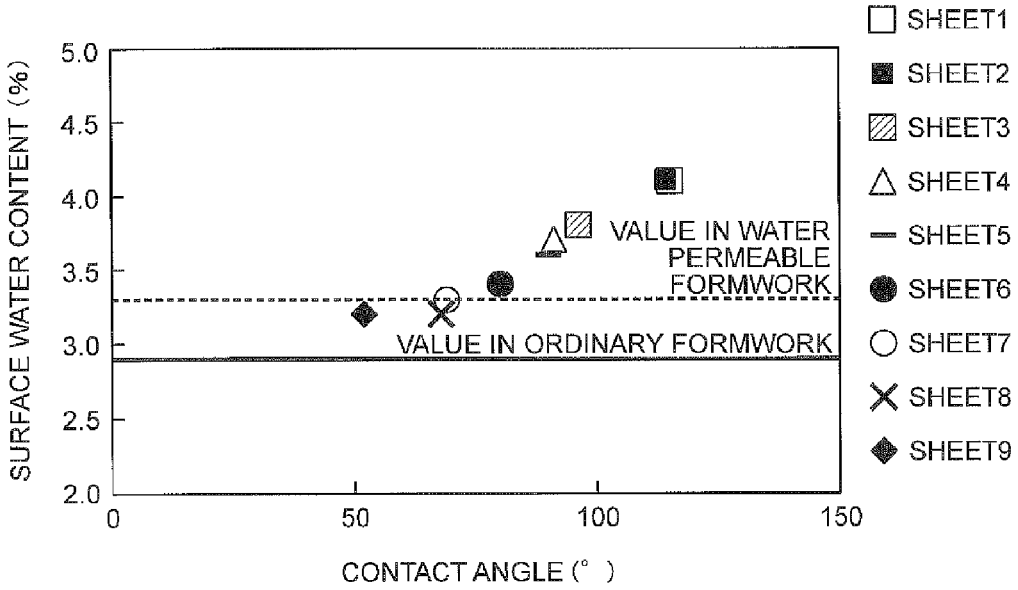
FIG. 46 is a graph showing the measurement results of the surface water content in Examples.

FIG. 46 shows a relationship between the surface water content and the contact angle θ of the sheet contact surface with respect to the test pieces T of Examples 1 to 9 and Comparative Examples 1 and 2. The surface water content could be higher by attachment of the curing sheet in all the cases of Examples 1 to 9 than the case of the ordinary formwork in Comparative Example 1. When the contact angle was 68 degrees or more (Examples 6 to 8), the surface water content could be comparable with that of the water permeable formwork in Comparative Example 2. When the contact angle was 90 degrees or more (Examples 1 to 5), the surface water content could be much higher than that in use of the water permeable formwork in Comparative Example 2.

Subsequently, in order to confirms effectiveness of the curing sheet having a predetermined contact angle according to the present invention, attached in advance, the following comparative test was additionally performed. As shown in Table 6, physical properties shown in Table 5 were measured in and compared between the case where sheet 1 in Example 1 described above was used for an ordinary formwork (Example) and the case where only an ordinary formwork was simply used with no use of sheet 1 (Comparative Example). The same formulations of concrete and test pieces were used.

TABLE 5

| Items tested | Standards |
|---|---|
| Carbonation depth | Promotion carbonation test |
| Surface air bubble area ratio | Tracing paper method |
| Air permeability | Torrent method |
| Surface water absorption rate | — |
| Surface water content | Electromagnetic induction method |

TABLE 6

| | Steps | | |
|---|---|---|---|
| Methods | In placement | Material age of 5 days | Material age of 91 days |
| Comparative Example | Ordinary Formwork | Attachment of curing sheet immediately after demolding | Performance of measurements after detachment of curing sheet |
| Example | Attachment of curing sheet to ordinary formwork in advance | Demolding (curing sheet was left) | |

[Carbonation Depth]

Figure 47:
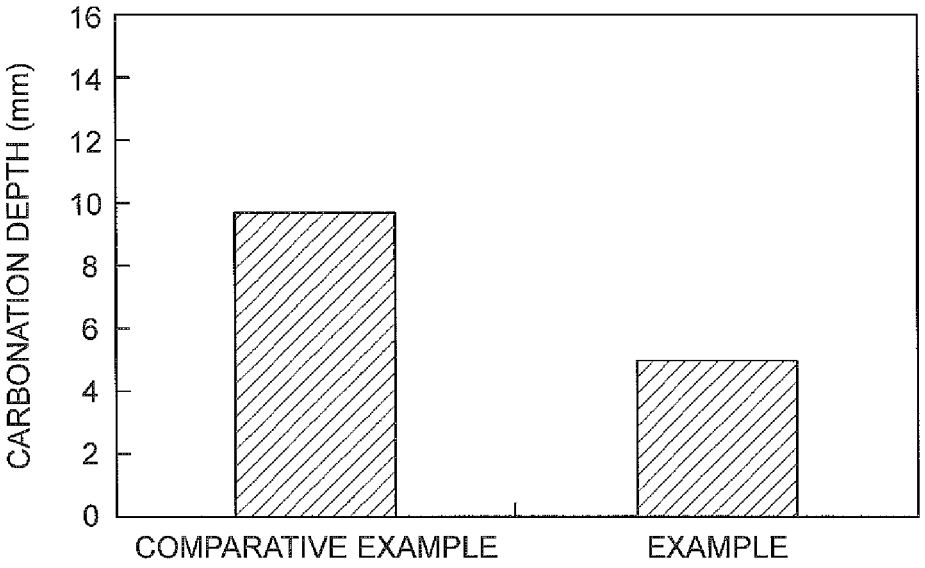
FIG. 47 is a graph showing the measurement results of the carbonation depth in the comparative test in Examples.

FIG. 47 shows the carbonation depth of the test piece T of each of Example and Comparative Example. As is clear from FIG. 47, while the carbonation depth in Comparative Example was about 10 mm, the carbonation depth in Examples was about 5 mm. The carbonation depth of the concrete structure could be much smaller by the manufacturing method of Example.

[Surface Air Bubble Area Ratio]

Figure 48:
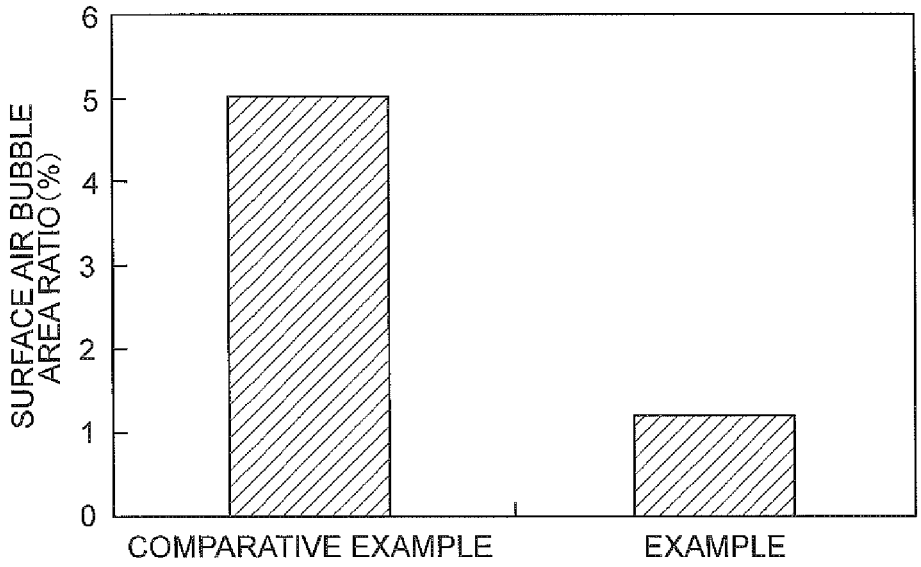
FIG. 48 is a graph showing the measurement results of the surface air bubble area ratio in the comparative test in Examples.

FIG. 48 shows the surface air bubble area ratio of the test piece T of each of Example and Comparative Example. As is clear from FIG. 48, while the surface air bubble area ratio in Comparative Example was 5%, the surface air bubble area ratio in Example was about 1.2%. The surface air bubble area ratio of the concrete structure could be much smaller by the manufacturing method of Example.

[Air Permeability]

Figure 49:
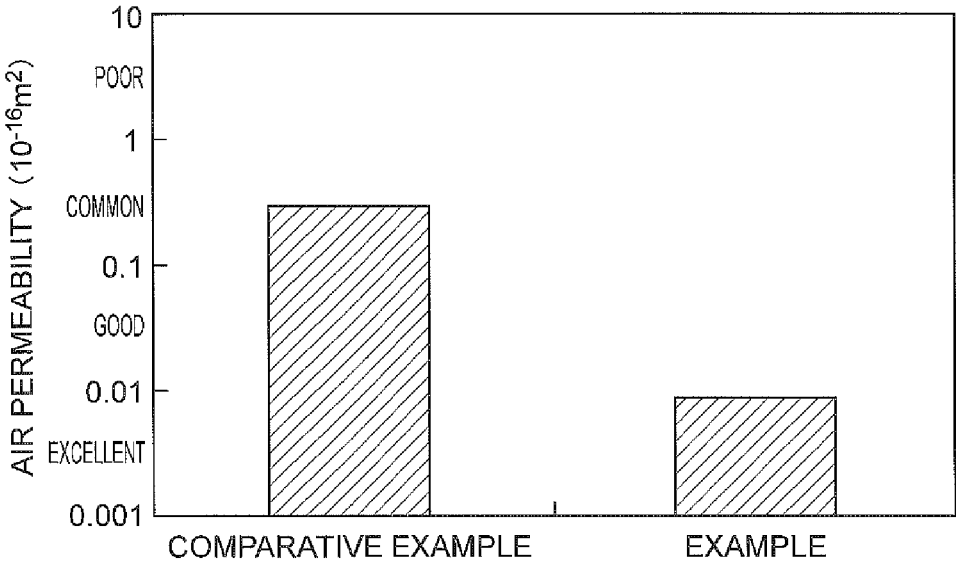
FIG. 49 is a graph showing the measurement results of the air permeability in the comparative test in Examples.

FIG. 49 shows the air permeability of the test piece T of each of Example and Comparative Example. As is clear from FIG. 49, while the air permeability in Comparative Example was from 0.1 to $1.0\times10^{-16}$ $m^2$ (common), the air permeability in Example was from 0.001 to $0.01\times10^{-16}$ $m^2$ (excellent). The air permeability of the concrete structure could be much smaller by the manufacturing method of Example.

[Surface Water Absorption Rate]

Figure 50:
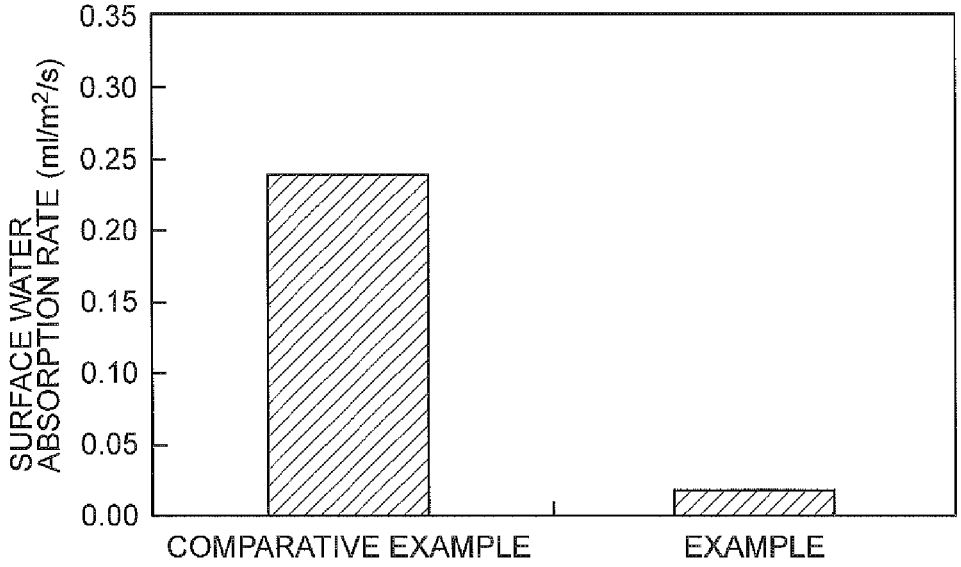
FIG. 50 is a graph showing the measurement results of the surface water absorption rate in the comparative test in Examples.

FIG. 50 shows the surface water absorption rate of the test piece T of each of Example and Comparative Example. As is clear from FIG. 50, the surface water absorption rate in Comparative Example was 0.24 $ml/m^2/s$, the surface water absorption rate in Example was 0.02 $ml/m^2/s$. The surface water absorption rate of the concrete structure could be much smaller by the manufacturing method of Example.

[Surface Water Content]

Figure 51:
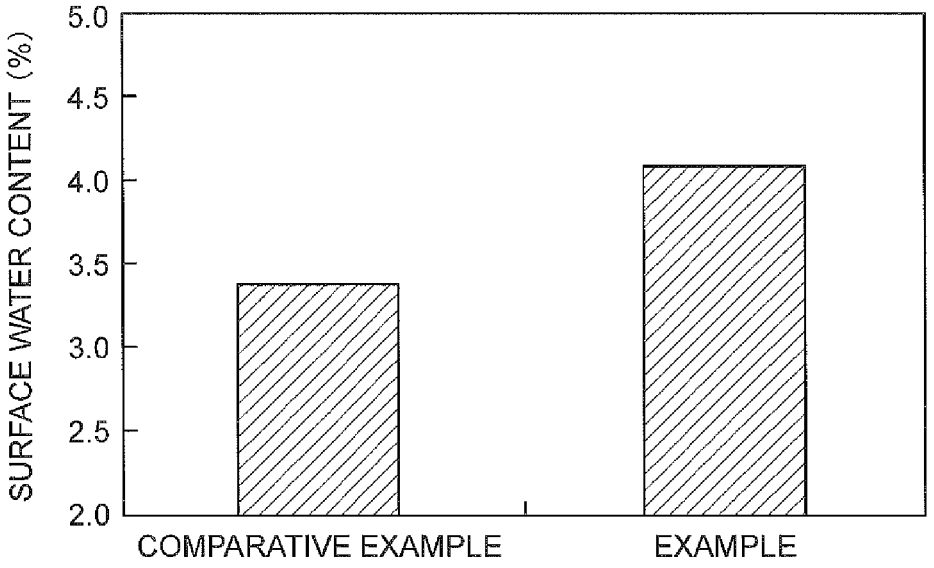
FIG. 51 is a graph showing the measurement results of the surface water content in the comparative test in Examples.

FIG. 51 shows the surface water content of the test piece T of each of Example and Comparative Example. As is clear from FIG. 51, while the surface water content in Comparative Example was 3.4%, the surface water content in Example was 4.1%. The surface water content of the concrete structure could be much higher by the manufacturing method of Example.

In addition, the outer appearance of the concrete surface of the test piece T formed in each of Example and Comparative Example was observed. The results are shown in FIG. 52 and FIG. 53.

Figure 52:
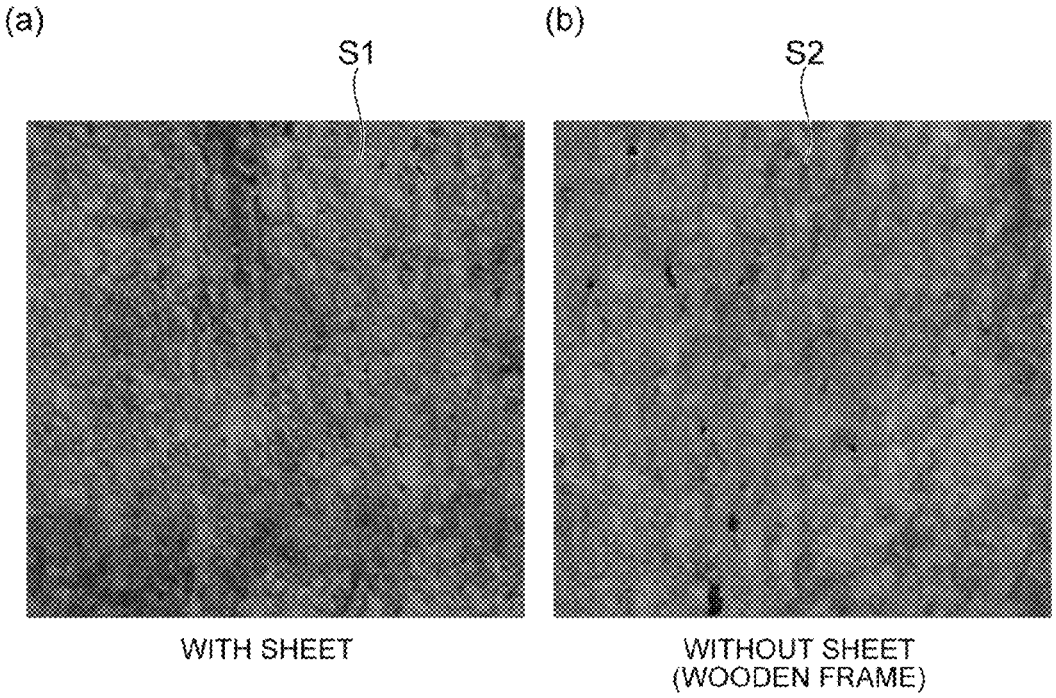
FIG. 52 is a photograph showing the concrete surface in the comparative test in Examples.

As is clear from the photographs in FIG. 52 and FIG. 53, many air bubbles were confirmed on the surface with respect to concrete surface S2 produced in Comparative Example. On the other hand, there were a few air bubbles on the surface with respect to concrete surface S1 produced in Example, and it was confirmed that the outer appearance was finished very beautifully. In particular, according to the photograph in FIG. 53, it was confirmed that concrete surface S1 produced in Example was glossy like a marble stone.

INDUSTRIAL APPLICABILITY

The present invention can be applied to a method for manufacturing a concrete structure and a concrete curing sheet for curing concrete.

REFERENCE SIGNS LIST

10, 20, 230, 315, 323, 331, 341, 351, 361 . . . Curing Sheet, 14, 24 . . . End portion, 16, 26 . . . Protruding portion, 30, 210, 220,310, 320, 330, 340, 350 . . . Formwork, 40 . . . Gummed tape, C, C1, C2 . . . Concrete structure.

The invention claimed is:

1. A method for manufacturing a concrete structure, comprising:

a mold installation step of installing a formwork for concrete placement;

a placement step of performing placement of concrete in a state where a non-pore curing sheet is attached to an inner surface of the formwork, the curing sheet made from a material selected from the group consisting of polypropylene, nylon, nylon 6, a perfluoroalkoxy fluororesin, a tetrafluoroethylene hexafluoropropylene copolymer, an ethylene tetrafluoroethylene copolymer, polyethylene terephthalate (PET), polyvinyl chloride, polyvinyl acetate, polyvinylidene chloride, and polyolefins and a demolding step of removing the formwork after placement of the concrete, wherein a water vapor permeability of the curing sheet is 10 $g/m^2\cdot24$ hours or less, and a contact angle of a contact surface of the curing sheet for use in the placement step with water is 50 degrees or more, the contact surface facing the concrete.

2. The method for manufacturing a concrete structure according to claim 1, further comprising a curing sheet attachment step of attaching the curing sheet inside the formwork in advance before the mold installation step.

3. The method for manufacturing a concrete structure according to claim 1, further comprising a curing step of curing the concrete structure for a predetermined period with the curing sheet left on an attaching surface of the concrete structure, after the demolding step.

4. The method for manufacturing a concrete structure according to claim 1, wherein the contact angle of the contact surface of the curing sheet for use in the placement step with water is 69 degrees or more.

5. The method for manufacturing a concrete structure according to claim 4, wherein the contact angle of the contact surface of the curing sheet for use in the placement step with water is 80 degrees or more.

6. The method for manufacturing a concrete structure according to claim 5, wherein the contact angle of the contact surface of the curing sheet for use in the placement step with water is 90 degrees or more.

7. The method for manufacturing a concrete structure according to claim 1, wherein the material from which the curing sheet is made comprises polypropylene, polyethylene terephthalate, polyvinylidene chloride or polyvinyl chloride.

8. The method for manufacturing a concrete structure according to claim 1, wherein a thickness of the curing sheet for use in the placement step is 0.1 mm or more.

9. The method for manufacturing a concrete structure according to claim 1, further comprising a bar arrangement step of arranging a predetermined reinforcing bar, wherein a reinforced concrete structure is manufactured as the concrete structure.

10. The method for manufacturing a concrete structure according to claim 1, wherein in the placement step, concrete placement is performed in a state where a heat insulation material is disposed between the curing sheet and the formwork, and in the demolding step, the formwork is removed with the heat insulation material being left.

11. The method for manufacturing a concrete structure according to claim 1, wherein in the placement step, a surface of the curing sheet, on which concrete is to be placed, is coated with at least one of a surface modifier, a shrinkage reducer, a water absorption inhibitor and a release agent for performing concrete placement.

12. The method for manufacturing a concrete structure according to claim 1, comprising a providing step of providing a formwork having a plurality of openings which is to face concrete placed, and having an internal void linked to the openings, and the curing sheet for curing concrete placed; and, a pressure reduction step of mounting the curing sheet to a surface of the formwork which is to face concrete placed so as to cover the plurality of openings, and reducing atmospheric pressure in the internal void, wherein, in the placement step, concrete placement is performed in a state where the curing sheet is attached, by the pressure reduction step, to a surface of the formwork which is to face concrete placed.

13. The method for manufacturing a concrete structure according to claim 1, wherein a predetermined holding device is used in at least any step of the mold installation step, the placement step and the demolding step to thereby leave the curing sheet on the concrete after removing the formwork.

* * * * *